US007150683B2

(12) United States Patent
Bender

(10) Patent No.: US 7,150,683 B2
(45) Date of Patent: Dec. 19, 2006

(54) GOLF SWING TRAINING METHOD AND APPARATUS

(75) Inventor: Michael E. Bender, Sanford, FL (US)

(73) Assignee: Benolt, LLC, Orange Park, FL (US)

( * ) Notice: Subject to any disclaimer, the term of this patent is extended or adjusted under 35 U.S.C. 154(b) by 0 days.

(21) Appl. No.: 11/264,656

(22) Filed: Feb. 13, 2006

(65) Prior Publication Data

US 2006/0121999 A1 Jun. 8, 2006

Related U.S. Application Data

(63) Continuation of application No. 10/657,326, filed on Sep. 8, 2003, now Pat. No. 6,988,957.

(60) Provisional application No. 60/460,691, filed on Apr. 4, 2003.

(51) Int. Cl.
*A63B 69/36* (2006.01)

(52) U.S. Cl. ..... 473/266; 473/274; 473/275; 473/277

(58) Field of Classification Search ..... 473/218, 473/227, 231, 238, 257, 261, 262, 263, 264, 473/265, 266, 267–277
See application file for complete search history.

(56) References Cited

U.S. PATENT DOCUMENTS

| | | | |
|---|---|---|---|
| 1,209,031 | A | 12/1916 | Rind |
| 1,936,143 | A | 11/1933 | Shea |
| 2,611,610 | A | 9/1952 | Hara |
| 2,891,796 | A | 6/1959 | Cottrell |
| 3,215,438 | A | 11/1965 | Sheldon et al. |
| 3,397,892 | A | 8/1968 | Stahl |
| 3,623,733 | A | 11/1971 | Cavanaugh |
| 3,698,721 | A | 10/1972 | Stewart |
| 3,712,625 | A | 1/1973 | Taylor |
| 4,047,605 | A | 9/1977 | Rosenvold |
| 4,071,251 | A | 1/1978 | Beckish |
| 4,116,447 | A | 9/1978 | Becker |
| 4,211,418 | A | 7/1980 | Oppenheimer |
| 4,326,718 | A | 4/1982 | Keihl |
| 4,513,972 | A | 4/1985 | Empie |
| 4,521,023 | A | 6/1985 | Williams |
| 4,538,815 | A | 9/1985 | Poirier |
| 4,583,740 | A | 4/1986 | Ohly |
| 4,651,994 | A | 3/1987 | Lee |
| 4,659,084 | A | 4/1987 | Vuick |
| 4,758,000 | A | 7/1988 | Cox |
| 4,758,001 | A | 7/1988 | Otting et al. |
| 4,779,872 | A | 10/1988 | Bisbee |
| 4,815,743 | A | 3/1989 | Meeker et al. |
| 4,852,881 | A | 8/1989 | Bellagamba et al. |
| 4,948,142 | A | 8/1990 | Taber |
| 4,993,716 | A | 2/1991 | Waller |
| 4,998,731 | A | 3/1991 | Bowen |

(Continued)

*Primary Examiner*—Nini F. Legesse
(74) *Attorney, Agent, or Firm*—Allen, Dyer, Doppelt, Milbrath & Gilchrist, P.A.

(57) ABSTRACT

A golf swing training apparatus increases the efficiency of the training process for a desired golf swing. Multiple training apparatus are mounted on a support base to define the proper golf swing path and corresponding body movement. The golfer strikes a barrier when the golf swing is performed in an undesirable manner, thus providing negative feedback in the training of the desired swing yet positive results. The apparatus allows a golfer to practice a selected swing without restraints to facilitate muscle memory of an optimal golf swing and with optimal body movement.

1 Claim, 19 Drawing Sheets

U.S. PATENT DOCUMENTS 5,013,044 A 5/1991 Hesselbart
5,039,105 A 8/1991 Ro
5,050,885 A 9/1991 Ballard et al.
5,184,295 A 2/1993 Mann
5,203,569 A 4/1993 Rilling
5,221,089 A 6/1993 Barrett
5,255,921 A 10/1993 Spence
5,288,074 A 2/1994 Scheurer
5,303,926 A 4/1994 Owens et al.
5,334,028 A 8/1994 Melligan
5,439,226 A 8/1995 Luedtke
5,591,090 A 1/1997 Kauffman, Jr.
5,616,085 A 4/1997 LaCoste et al.
5,634,858 A 6/1997 Bellagamba
5,707,300 A 1/1998 May et al.
5,762,565 A 6/1998 Milam et al.
5,769,732 A 6/1998 O'Neal
5,830,079 A 11/1998 Hudson
5,916,037 A 6/1999 Hill
5,984,797 A 11/1999 Kessler et al.
5,984,798 A 11/1999 Gilmour
6,024,656 A 2/2000 Lane
6,106,408 A 8/2000 Roman
6,174,270 B1 1/2001 Dagenais
6,273,826 B1 8/2001 Bauer
6,312,345 B1 11/2001 Pelz
6,322,456 B1 11/2001 Benggon
6,343,998 B1 2/2002 Tarulli et al.
6,364,786 B1 4/2002 Khano
6,371,863 B1 4/2002 Moran
6,402,633 B1 6/2002 Hsiung et al.
6,431,991 B1 8/2002 Kossnar et al.
6,440,004 B1 8/2002 Rodriguez
6,497,627 B1 12/2002 Collins
6,500,075 B1 12/2002 McDevitt
6,551,196 B1 4/2003 Kossnar et al.
6,575,844 B1 6/2003 Gray
6,932,712 B1 8/2005 Cardosi
2003/0064821 A1 4/2003 Pope

GOLF SWING TRAINING METHOD AND APPARATUS

CROSS REFERENCE TO RELATED APPLICATION

This application is a continuation of U.S. application Ser. No. 10/657,326 now U.S. Pat. No. 6,988,957 filed on Sep. 8, 2003 which claims priority to Provisional Application Ser. No. 60/460,691 for "Golf Swing Training Method and Apparatus" having filing date Apr. 4, 2003, the disclosures of which are herein incorporated by reference in their entireties all commonly owned.

FIELD OF THE INVENTION

This invention generally relates to golf swing training and more particularly to a training method and apparatus for providing feedback to a golfer seeking a desirable golf swing.

BACKGROUND

Golf swing training devices are well known to come in many forms and promote a variety of techniques for improving ones golf swing. The conventional wisdom appears to be that training methods should employ positive feedback. Such positive feedback training methods typically include restraints and guides that are worn by the golfer to restrict his or her motion. Such positive feedback training equipment is typically attached to various parts of the body to teach the body the correct movements.

More specifically, a typical positive feedback training device restrain the golfer's body to maintain the proper position during a golf swing. The golfer may be strapped to the training device and prevented by the restraints from moving out of the proper position. Thus, during a practice swing a golfer is prevented from having an improper stance and incorrect body movement. The restraints are attached either alone or in combination to the head, shoulders, hips and legs.

By way of example, a typical restraint may force a golfer to keep his or her head down during the golf swing. Similarly, hip and shoulder restraints may be fastened around the hips and shoulders, respectively, to limit lateral movement. Leg restraints are also used to assist a golfer in the proper body weight shift during a golf swing.

Another body restraint may use a shoulder blade brace for allowing a natural movement of the body in making the golf swing and at the same time preventing the golfer from moving out of position. However, the golfer does not receive any correction when the restraints are not worn and of course such restraints may not be worn during competition.

Other training devices may incorporate attachments to a golf club for forcing the golfer to swing in a predetermined arc pattern to simulate the kinematics of a proper golf swing. Typically, a golfer practices a golf swing a number of times with the body restraints, the golf club restraints, or both, in an attempt to improve the golf swing. The golfer repeatedly practices the swing using the swing guide until the swing feels comfortable. The golfer then imitates the swing without being constrained in an attempt to simulate the golf swing that was practiced with the assistance of the swing guide.

The positive feedback approach that has been harnessed typical training devices does not provide any correction or feedback after the training device is removed. The golfer simply tries to imitate the same swing without the training device and the golfer will not know if the desired swing is being made. Although some improvement is possible using positive feedback training devices, such positive feedback during the training process is not the most efficient way to improve a golf swing.

In summary, previous attempts or teachings for improving the golf swing have not provided a training system by which the body movements of a proper golf swing are taught to a golfer using negative feedback and in such a manner to allow the golfer to be removed for the training environment and effectively maintain the teaching principles. Specifically, typical apparatus typically use positive feedback and restraints to teach a desired golf swing yet do not allow the golfer to practice a golf swing without the restraints and concurrently provide the kinematics of a proper golf swing.

There is a need for an improved and more efficient method and associated apparatus for the training of a golf swing that will achieve better results without using restraints.

SUMMARY OF THE INVENTION

The long-standing but heretofore unfulfilled need for a golf swing training apparatus that eliminates body and golf club restraints and is adaptable to an unlimited number of different golfers is provided by the present invention.

One embodiment of the present invention includes a golf swing training apparatus includes a base and a plurality of interchangeable training apparatus. Each training apparatus is removably attached to the base. Different combinations of the training elements are used depending upon the instruction desired by the golfer.

The golf swing training method and system of the present invention is drawn to a system that incorporates negative feedback which serves as a teaching method to correct a golf swing.

The golf training system includes a base having a planar configuration that is adapted to overlie a support surface. At least one apparatus for golf training is adapted to be mounted on the base. The at least one apparatus includes at least one barrier that is struck by a golfer making a golf swing if the golf swing is not performed in an optimal manner.

The golf training system is adapted to be used by a golfer in a ball-addressing stance where the golfer's shoulders are substantially parallel to a longitudinal target line and where the golfer's feet are substantially transverse to the target line.

Striking the at least one barrier provides negative feedback that the golfer can use to improve the golf swing until it is an optimal golf swing.

A first apparatus includes a horizontally disposed plate that is positioned atop a golfer's head in abutting relation thereto prior to making a golf swing. A padded, horizontally disposed rod is positioned against a dominant temple of the golfer prior to making the golf swing. The golfer's head maintains contact with the horizontally disposed plate and the horizontally disposed rod during the performance of the golf swing.

The horizontally disposed plate and the horizontally disposed rod provide negative feedback to the golfer if the golfer's head changes levels during the swing and if the golfer's head moves toward the horizontally disposed rod during the golf swing.

Height adjustment means enables the height of the horizontally disposed plate to be adjusted in accordance with the height of a golfer. Width adjustment means enables the longitudinal position of the horizontally disposed rod to be adjusted in accordance with a position adopted by the golfer relative to the apparatus. Depth adjustment means enables the transverse position of the horizontally disposed rod to be adjusted in accordance with a position adopted by the golfer relative to the apparatus.

A second apparatus includes an arcuate surface, herein described by way of example as a ball or spherical shape, positioned in abutting relation to a golfer's dominant knee joint on the posterior side thereof, a front barrier wall positioned in abutting relation to the golfer's dominant knee joint on the anterior side thereof, and a side barrier wall positioned in abutting relation to the golfer's dominant knee joint on the dominant side thereof.

The golfer positions his or her dominant knee joint between the arcuate surface and the front barrier wall, positions the dominant side of the dominant knee in abutting relation to the side barrier wall, and bends the knee joint by a predetermined amount prior to performing a golf swing.

The side barrier wall prevents the golfer's dominant leg from moving longitudinally towards the dominant side of the golfer's body during the back swing. The spherical ball and the front barrier wall cooperate with one another to cause the golfer to lose balance if an attempt is made to straighten the dominant knee during the golf swing. The golfer's dominant knee is constrained to move longitudinally, parallel to the target line.

Height adjustment means enables adjustment of the height of the spherical ball, the front barrier wall, and the side barrier wall in accordance with the height of a golfer. Width adjustment means enables adjustment of the longitudinal position of the spherical ball, the front barrier wall, and the side barrier wall in accordance with a position adopted by the golfer relative to the apparatus. Depth adjustment means enables adjustment of the transverse position of the spherical ball, the front barrier wall, and the side barrier wall in accordance with a position adopted by the golfer relative to the apparatus.

A third apparatus includes a first elongate telescoping pole that is pivotally mounted for movement in a vertical plane so that it can be tilted from the vertical plane so that a distal end of the pole is positioned over the golfer's dominant shoulder when the golfer is in a ball-addressing position. The pole serves as a barrier that is struck by the golfer's arms if his or her arms are lifted to a height above an optimal height during the back swing.

The third apparatus further includes a second elongate, telescoping pole that is pivotally mounted for movement in a vertical plane so that it can be tilted from the vertical plane so that a distal end of the pole is positioned over the golfer's non-dominant shoulder in parallel relation to the first pole when the golfer is in a ball-addressing position. The second pole serves as a barrier that is struck by the golfer's arms if the arms are lifted to a height above an optimal height during the follow-through.

Height adjustment means enables the respective lengths of the first and second elongate telescoping poles to be adjusted to accommodate golfers of differing heights. Width adjustment means enables adjustment of the distance between the first elongate telescoping pole and the second elongate telescoping pole to accommodate golfers of differing shoulder widths. Depth adjustment means enables the adjustment of the respective transverse positions of the first and second elongate telescoping poles.

A fourth apparatus includes a vertically disposed barrier wall adapted to be positioned on a non-dominant side of the golfer in abutting relation to the golfer's non-dominant leg a few inches below the golfer's non-dominant hip when the golfer is in a ball-addressing position. The barrier wall provides negative feedback to the golfer if the body of the golfer moves toward the target hole during the forward motion of the swing. In this way, the golfer learns to make the swinging motion more rotary than linear and further learns to shift weight to the non-dominant leg at the conclusion of the swing.

Height adjustment means is provided for raising and lowering the barrier wall to accommodate golfers of differing heights. Depth adjustment means enables transverse adjustment of the barrier wall in accordance with a position adopted by the golfer relative to the apparatus.

A fifth apparatus includes a vertical rod adapted to be positioned just inside the stance line of a golfer, in spaced apart relation from the dominant side of the golfer. The vertical rod serves as a barrier means that is struck by a club head during a take-away if the club head travels more than a predetermined optimal amount inside a plane that is parallel to the stance line.

Height-adjustment means enables adjustment of the height of the vertical rod so that the vertical rod has utility as a barrier means for golfers of differing heights. Depth-adjustment means are provided for adjusting the depth of the vertical rod relative to the stance line. Width or longitudinal adjustment means are provided for adjusting the distance of the vertical rod from the dominant side of the golfer's body so that the vertical rod has utility as a barrier means for golfers of differing arm lengths.

A sixth apparatus includes a barrier means disposed transversely, i.e., at a ninety degree (90°) angle relative to the target line. The barrier is positioned on the non-dominant side of the golfer in a longitudinally spaced relation depending upon the length of the golfer's arms. If the club is hinged in a non-optimal way by the wrists of the golfer, the club strikes the barrier means. This provides negative feedback.

The barrier may be formed of a transparent material so that a video camera positioned on the non-dominant side of the golfer, with the transparent barrier means positioned between the camera means and the golfer, may record the golfer's swing for diagnostic purposes.

Height adjustment means enables adjusting the height of the barrier means so that it has utility for golfers of differing heights. Width adjustment means enables adjusting the transverse position of the barrier means relative to the golfer.

The sixth apparatus further includes a vertically disposed, longitudinally extending flap mounted on the barrier means. The vertically disposed flap is positioned in a plane that is slightly rearwardly of a plane, parallel to a target line, through which the golf club travels during an optimal take-away. The vertically disposed flap therefore provides a barrier means that is struck by the golf club if the golfer does not perform an optimal take-away.

A seventh apparatus includes a horizontally disposed rod mounted on the barrier of the sixth apparatus. The rod extends longitudinally towards the golfer in a plane parallel to the target line. The rod has a distal free end that provides a barrier that is struck by the golfer's hands during take-away if the golfer's hands move away from the golfer's body during take-away and during the down swing if the golfer's hands move away from the golfer's body during the down swing. A cushioned pad is slideably disposed in covering relation to the rod to mitigate injury to the golfer's hands in the event of contact.

An eighth apparatus includes a hemispherical barrier disposed at a predetermined optimal angle relative to the target line. The hemispherical barrier is positioned on the non-dominant side of the golfer at a longitudinal distance equal to about one club length. The hemispherical barrier means provides negative feedback when struck during a take-away that is not performed in an optimal manner. The hemispherical barrier also provides negative feedback when struck during a down swing that is not performed in an optimal manner. The hemispherical barrier is pivotally mounted for rotation about a vertical axis to enable adjustment of its angular position relative to the target line.

Depth adjustment means enables the apparatus to be positioned at differing depths relative to the target line and longitudinal adjustment means enables the apparatus to be positioned at differing lengths from the golfer to accommodate golfers having differing arm lengths.

A ninth apparatus includes a planar barrier positioned at a predetermined optimal angle relative to a target line. The planar barrier is adapted to be spaced a predetermined optimal distance from a golfer's dominant shoulder. The planar barrier provides negative feedback if the back swing and down swing are not performed in an optimal manner. The golfer's hands will strike the barrier in either event.

Height and depth-adjustment means are provided to adjust the height and depth, respectively, of the planar barrier means. An angle adjusting means is provided for adjusting the angle between the planar barrier and the target line. A cushioned pad is disposed in protective, overlying relation to the planar barrier means to mitigate injury to the golfer's hands if the planar barrier means is struck by the golfer's hands. Moreover, the planar barrier is mounted so that it will break away from its mount if struck, thereby further mitigating injury.

A horizontally disposed elbow barrier adapted to be positioned on the dominant side of a golfer at about shoulder height is one element of the tenth apparatus. The elbow barrier is positioned at a longitudinal spacing equal to about the length of the golfer's upper arm. The elbow barrier provides negative feedback to the golfer when the golfer performs a back swing and lifts the dominant elbow more than ninety degrees (90°) relative to the position of the elbow at address.

Height adjustment means are provided so that the elbow barrier means is adjustable to accommodate golfers of differing heights. Width adjustment means are also provided so that the elbow barrier means is adjustable to accommodate golfers having upper arms of differing lengths. Depth adjustment means are provided as well so that the elbow barrier means is adjustable to accommodate golfers of differing body depths.

The eleventh apparatus includes an angled planar barrier disposed in an angled plane at a predetermined optimal angle relative to a vertical plane so that a top edge of the angled planar barrier is adapted to be closer to a golfer's head than a bottom edge thereof. The angled planar barrier is adapted to provide negative feedback to a golfer at the top of a golf swing if the arms of the golfer and the club shaft are not in an optimal position at the top of the golf swing. More particularly, the club shaft strikes the angled planar barrier at the top of the golf swing if the golf swing is non-optimal. In a preferred embodiment, the angled planar barrier is formed of glass.

Height-adjustment means are provided so that the angled planar barrier is adjustable to accommodate golfers of differing heights. Adjustment means are also provided for adjusting the position of the angled planar barrier in the angled plane to accommodate golfers of differing heights.

The twelfth apparatus includes a club head barrier positioned at a location where a golf ball to be put into play would be positioned so that a golfer may adopt a ball-addressing stance and position a club head into abutting contact with the club head barrier. Muscle memory of an optimal stance to be adopted at the moment of ball impact is therefore acquired.

The twelfth apparatus further includes a club shaft barrier positioned at a location where a club shaft would be positioned at the moment of impact so that a golfer may adopt a ball-addressing stance and position a club shaft into abutting contact with the club shaft barrier. Muscle memory of an optimal stance to be adopted at the moment of ball impact is therefore acquired.

Height adjusting means associated with the club shaft barrier is provided to accommodate golfers of differing heights. Depth adjusting means associated with the club shaft barrier is provided to accommodate golfers of differing body thickness.

The club shaft barrier is adjustably mounted for pivotal movement in a vertical plane that is transversely disposed relative to the target line to accommodate golfers of differing heights. A depth adjustment means and a width adjustment means are also associated with the club head barrier.

The thirteenth apparatus includes a pole mounted in upstanding relation to the base. The pole has a follow-through barrier rod secured thereto that extends transversely therefrom in a horizontal plane at a ninety-degree (90°) angle relative to a target line. The follow-through barrier rod is adapted to be positioned on the non-dominant side of a golfer. It provides negative feedback to a golfer if the hands of the golfer strike the follow-through barrier rod during a golf swing follow-through.

Height adjustment means are provided for adjusting the height of the follow-through barrier to accommodate golfers of differing heights. Width adjustment means are provided for adjusting the longitudinal position of the follow-through barrier to accommodate golfers of differing arm lengths, and depth adjustment means are provided for adjusting the transverse position of the follow-through barrier to accommodate golfers of differing body thickness.

The final exemplary apparatus teaches a golfer how to set up for a putt. It includes a base having a longitudinally extending main part disposed in parallel with a target line. A pair of brackets are secured to the base, there being one bracket at each end thereof. An elongate guide plate has opposite ends that are secured by the brackets. The brackets are adapted to enable height-adjustability of the elongate guide plate and pivotal movement of the elongate guide plate about a longitudinal axis.

A knee position-locking mechanism is provided for holding a golfer's knees in a predetermined optimal position. The knee position-locking mechanism is independently adjustable along a longitudinal extent thereof. The height of the knee position-locking mechanism is also adjustable.

Longitudinally extending shoulder and forearms guides are provided for positioning a golfer's shoulders and forearms in an optimal position.

In a first configuration of the apparatus, the elongate guide plate is positioned at a predetermined angle that matches an angle of a golf club shaft when addressing a golf ball to be putted. A golfer learns an optimal putting stance for performing a golf putt of the arc stroke type by placing his or her knees in abutting relation to the knee position-locking mechanism, placing his or her shoulders and forearms in parallel relation to the shoulder and forearms guide, positioning a golf club shaft in overlying, abutting relation to the elongate-guide plate, and performing a golf putting stroke of the arc stroke type by maintaining the golf club shaft in abutting relation to the elongate guide plate during the putting stroke.

In a second configuration, the elongate guide plate is positioned in a vertical plane. A golfer learns an optimal putting stance for performing a golf putting stroke of the straight back straight through type by placing his or her knees in abutting relation to the knee position-locking mechanism, placing his or her shoulders and forearms in parallel relation to the shoulder and forearms guide, positioning a golf club heel in abutting, overlying relation to the elongate guide plate, and performing a golf putting stroke of the straight back straight through type by maintaining the heel of the golf club shaft in abutting relation to the vertically disposed elongate guide plate during the putting stroke.

In configurations, the shoulder and forearms guide is pivotally mounted for rotation about a longitudinal axis parallel to the target line to enable the shoulder and forearm guiding means to be adjusted for golfers of differing heights.

The fourteen apparatus are not exhaustive of the invention. Many more such apparatus can be built in light of this disclosure, and all apparatus of the type disclosed herein that incorporate the inventive features hereof are within the scope of this invention. Embodiments of the invention provide a golf swing training apparatus that does not require body movement restraints or golf club restraints. Embodiments of the present invention are fully adjustable to accommodate a variety of golfers. Negative reinforcement is provided during the gold swing training using the interchangeable apparatus alone or in combination with other apparatus. Embodiments of the invention herein described are intended to be economical in construction while providing a universal mechanical training system for a golfer that indicates the correct position of different parts of the body.

It is to be understood that both the foregoing general description and the following detailed description are explanatory and are not restrictive of the invention. The accompanying drawings, which are incorporated in and constitute part of the specification, illustrate embodiments of the present invention and together with the general description, serve to explain principles of the present invention. The invention accordingly comprises the features of construction, combination of elements, arrangement of parts, and methods that will be exemplified in the description set forth hereinafter.

BRIEF DESCRIPTION OF THE DRAWINGS

For a fuller understanding of the nature and objects of the invention, reference is made to the following detailed description, taken in connection with the accompanying drawings, in which:

FIG. 5A is a perspective view of an apparatus that trains a golfer not to lift his or her arms too high during a back swing and follow-through;

DETAILED DESCRIPTION OF THE PREFERRED EMBODIMENTS

Figure 1:
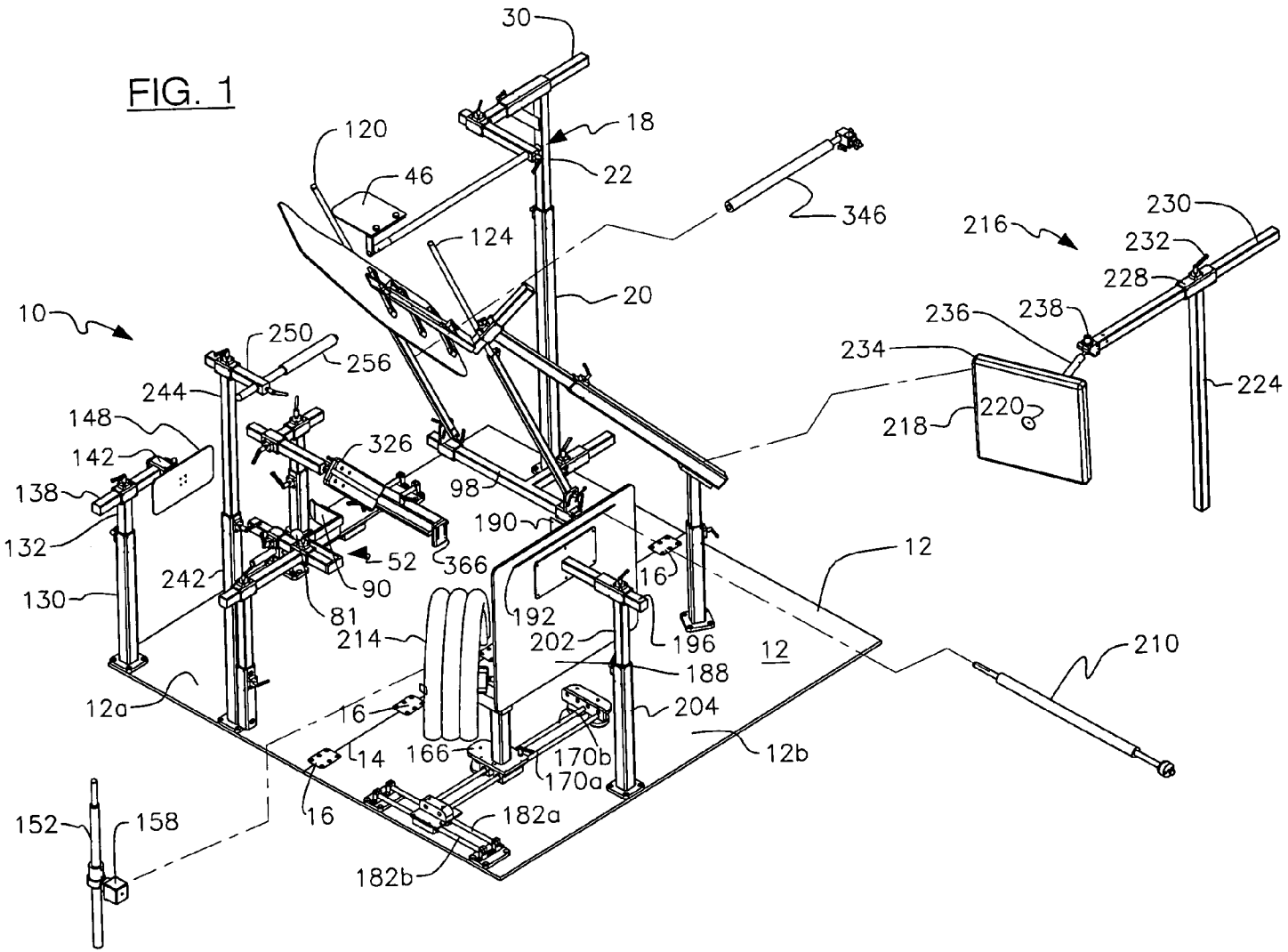
FIG. 1 is a perspective view of one preferred embodiment of the present invention golf swing training apparatus.

Referring initially to FIG. 1, it will be seen that the reference numeral 10 denotes one embodiment of a golf swing training system 10 has been described by way of example. Base 12 provides a foundation that supports each of the training apparatus. Each training apparatus is directed to an aspect of a golf swing. The training apparatus are adjustable and may be configured for either right handed or left handed golfers and are further adjustable to accommodate a particular golfer's physiology.

By way of example, a right-handed golfer addresses the ball with his or her right foot remote from the target and the left foot closer to the target. A left-handed golfer addresses the ball with his or her left foot remote from the target and the right foot closer to the target. Accordingly, each training apparatus disclosed herein is simply transposed for a left-handed golfer (not shown).

Figure 2:
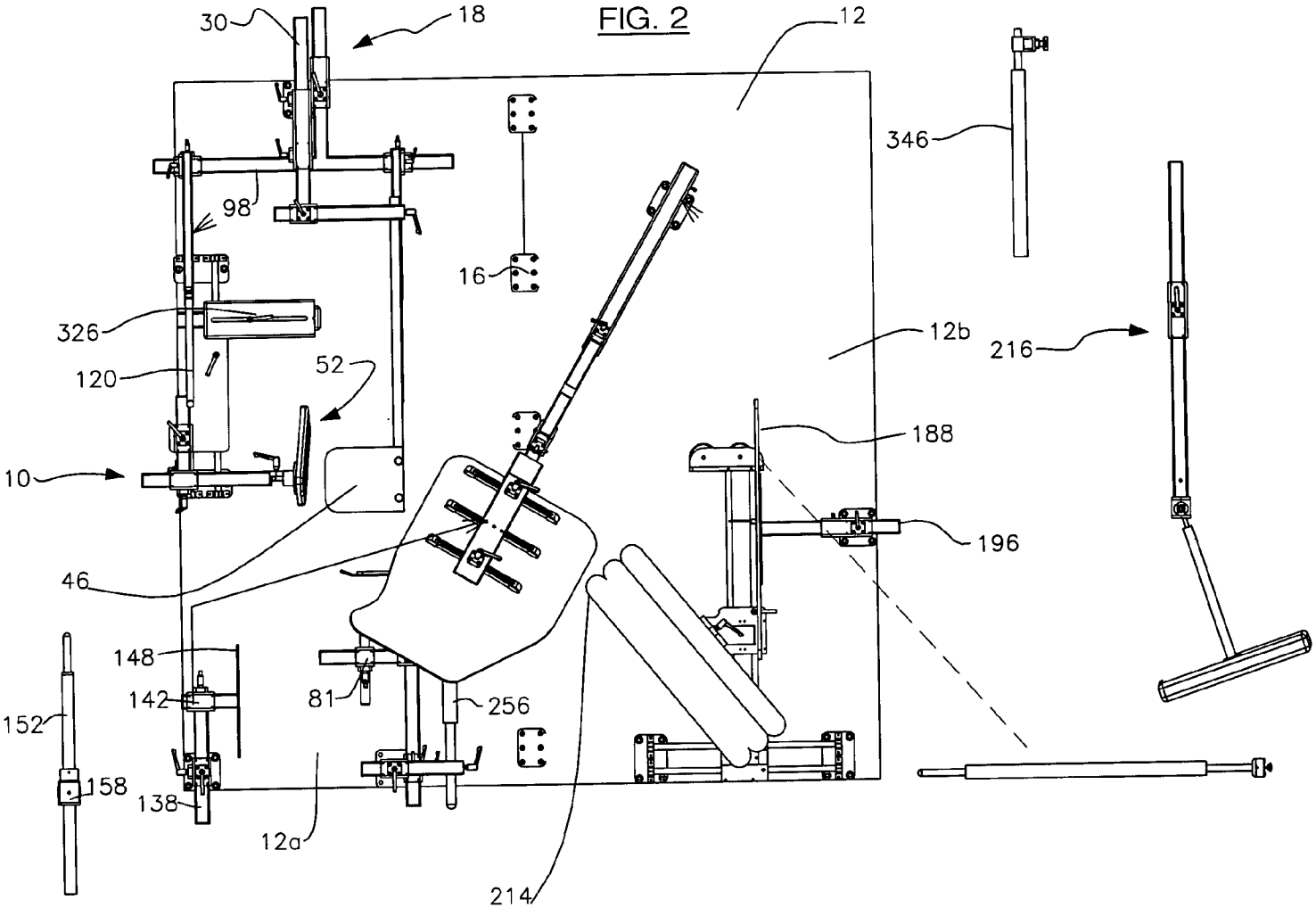
FIG. 2 is a top plan view of the apparatus depicted in FIG. 1.

As depicted in FIGS. 1 and 2, base 12 is preferably provided in two parts, denoted 12*a* and 12*b*, that meet along parting line 14 and are hingedly connected to one another by a plurality of equidistantly spaced hinges collectively denoted 16. This facilitates transportation of the system 10.

FIG. 2 provides a top plan view depicting the spacing between the various apparatus when all of them are mounted to the base 12 at the same time. In practice, only one or a few of the apparatus would be attached to base 12 at the same time, as desired for a predetermined practice routine.

Each apparatus teaches a golfer about a particular aspect of the sport. None of the apparatus are attached to the golfer or to the golf club at any time. Each apparatus is configured so that if a swing or part of a swing is performed in an optimal manner, as taught by a professional golf instructor by way of example, the golfer or the golf club will not strike any part of the apparatus. A swing performed in a non-optimal manner results in the golfer or the golf club striking a part of the apparatus. Such bumping provides negative reinforcement. Advantageously, a golfer acquires muscle memory when using each apparatus so that the golfer retains the learned motions during actual play when none of the apparatus that may collectively form system 10 is in use.

Multiple apparatus are herein described in a preferred embodiment of the present invention. All may be attached to the base 12 when in use, but one (that positions the golfer's body for a putting stroke) is herein described as a stand alone apparatus. It should be understood, however, that still further embodiments could be constructed in accordance with the teachings of this invention and such additional embodiments are therefore within the scope of this invention as defined in the claims appended hereto.

Figure 3B:
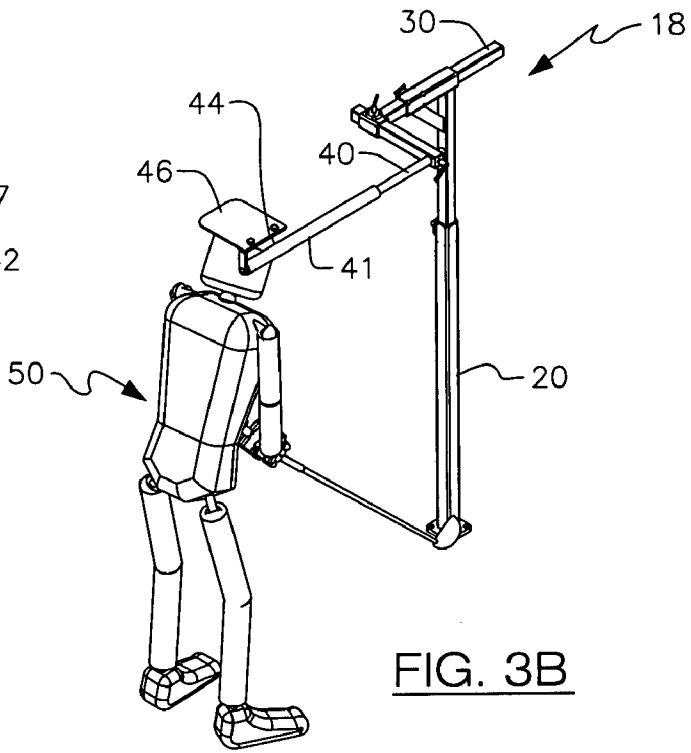
FIG. 3B is a perspective view of the apparatus of FIG. 3A and further includes a model golfer to demonstrate use of the apparatus.
Figure 3A:
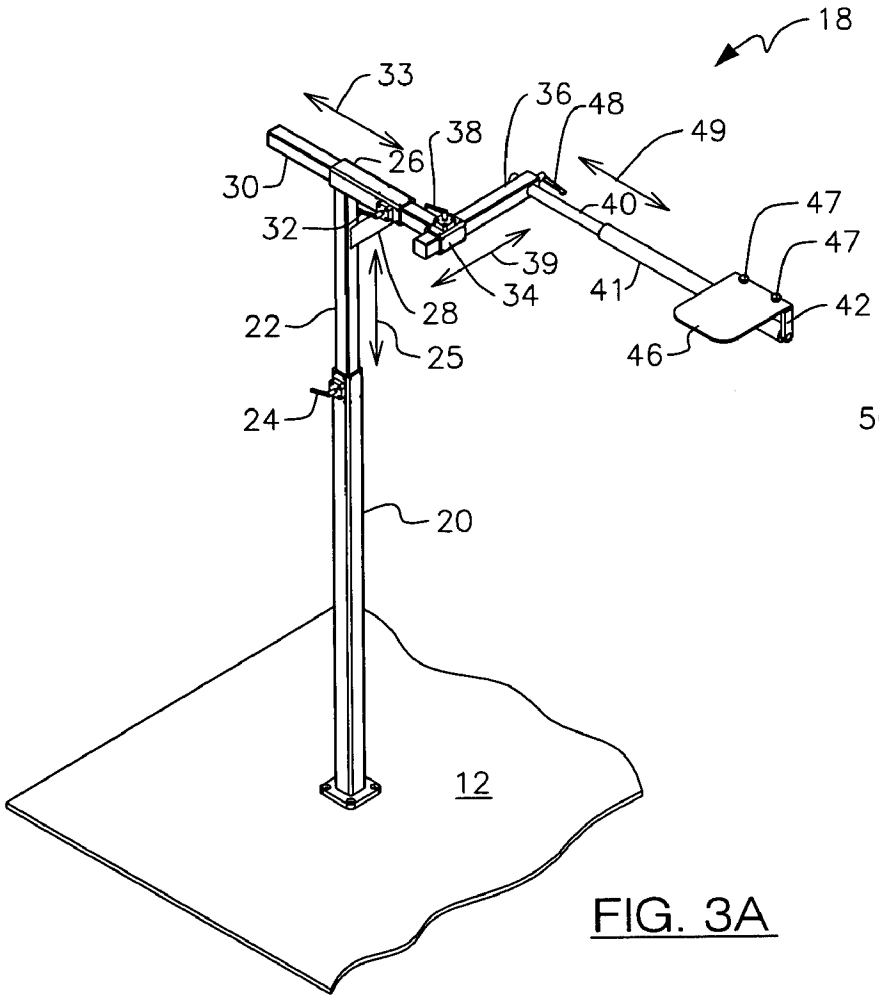
FIG. 3A is a perspective view of an apparatus that stabilizes a golfer's spine and head.

A "spine stabilizer and head freezer" apparatus 18 is illustrated again with reference to FIG. 1 and is depicted in FIGS. 3A and 3B. Apparatus 18 is positioned on the base 12 so that upstanding support post 20 is directly in front of the golfer when the golfer is in a ball-addressing stance. Throughout this disclosure, it should be understood that the feet of a golfer in a ball-addressing stance are positioned substantially perpendicular to a target line. A target line is an imaginary line that extends from a golf ball to a target such as a golf cup or hole, by way of example.

More particularly, when a golfer's feet are substantially perpendicular to a target line, the plane of the golfer's body is substantially parallel to the target line. Just as a target line extends longitudinally to a target, the plane of a golfer's body may also be thought of as a longitudinally-extending plane. Accordingly, a plane at right angles to the plane of a golfer's body, when the golfer is in a ball-addressing stance, may be called a transversely disposed plane. Such transversely disposed plane is thus substantially parallel to the golfer's feet when the golfer is in said ball-addressing stance.

Under such definitions, and with reference to FIG. 3B, it may be said that support post 20 is positioned in coincidence with a transversely disposed plane that generally bisects the golfer's body into a left portion and a right portion, half by way of example. It can also be said that the support post 20 is transversely spaced apart from the golfer, herein illustrated as model 50 later described. However, as will become more clear as this description proceeds, it is not critical that support post 22 be positioned in a transverse plane that precisely bisects the golfer's body because the operative parts of the apparatus 18 are longitudinally adjustable so that they can be brought into abutting contact with the golfer even when the golfer is not positioned such that the support post 20 is positioned in a transverse plane that precisely bisects his or her body.

Height-adjusting post 22 is telescopically received within hollow support post 20 and is lockable in an infinite plurality of functional positions of adjustment by hand-operated locking means 24. Double-headed directional arrow 25 in FIG. 3A indicates the telescopic movement of height-adjusting post 22 with respect to support post 20.

A hollow channel member 26 is horizontally and transversely disposed and surmounts post 22. Brace 28 extends between post 22 and hollow channel 26, supporting the latter. The hollow channel 26 slideably receives transversely disposed depth-adjustment post 30 and hand-operated locking means 32 enables locking of depth-adjustment post 30 in an infinite plurality of positions of functional adjustment relative to hollow channel 26. Double-headed directional arrow 33 indicates the telescopic movement of depth-adjustment post 30 with respect to hollow channel 26.

Truncate hollow channel member 34 is horizontally and longitudinally disposed and is secured to the leading end of depth-adjustment post 30. Width-adjustment post 36 is horizontally and longitudinally disposed and is slideably received within truncate hollow channel member 34 and is lockable in an infinite plurality of positions of functional adjustment relative to said truncate hollow channel member 34 by hand-operated locking means 38. Double-headed directional arrow 39 indicates the telescopic movement of width-adjustment post 36 with respect to hollow channel 34.

It is worth noting that adjustment of a part in a transverse plane is advantageously referred to herein as a depth adjustment because such adjustment brings such part closer to a golfer or further away from the golfer, it being understood that the golfer is facing such part. Similarly, adjustment of a part in a longitudinal plane is advantageously referred to herein as a width adjustment because such adjustment moves the part closer to the target or further away therefrom.

With continued reference to FIGS. 3A and 3B, unnumbered bore is formed in a trailing end of width-adjustment post 36 to slideably receive the trailing end of depth-adjustment pole 40. Padding 41 is added to the leading end of width-adjustment pole 40. An "L"-shaped bracket is secured to the leading end of depth-adjustment pole 40 and includes vertically extending part 42 and horizontal, transversely-extending part 44 that extends toward support post 20. Horizontal plate 46 is secured to part 44 by a pair of fasteners, collectively denoted 47.

Depth-adjustment pole 40 is lockable in an infinite plurality of positions of functional adjustment with respect to width-adjustment post 36 by hand-operated locking means 48. Double-headed directional arrow 49 indicates the telescopic movement of depth-adjustment pole 40 with respect to width-adjustment post 36.

The manner of use of apparatus 18 may best be understood in connection with FIG. 3B. By way of example, the right side of the head of a right-handed golfer, indicated by model 50, is positioned in an abutting relation to padding 41 and the top of the golfer's head is positioned in lightly abutting relation to the underside of the plate 46, with the plate 46 extending a few inches forwardly (transversely) relative to a contact area. By way of example, other padded depth-adjustment pole 40 prevent a right-handed golfer from moving his or her head to the right during the swing and the plate 46 prevents the head from changing levels during the swing. By identifying an optimal head placement at address, it becomes possible for the golfer to rotate around his spine throughout the swing.

In more generic terms, the golfer 50 is positioned with respect to apparatus 18 so that the dominant side of the golfer's head is in an abutting relation to padded pole 40. The position of plate 46 at the top of the golfer's head is the same regardless of which side is the dominant side for the golfer.

Figure 4B:
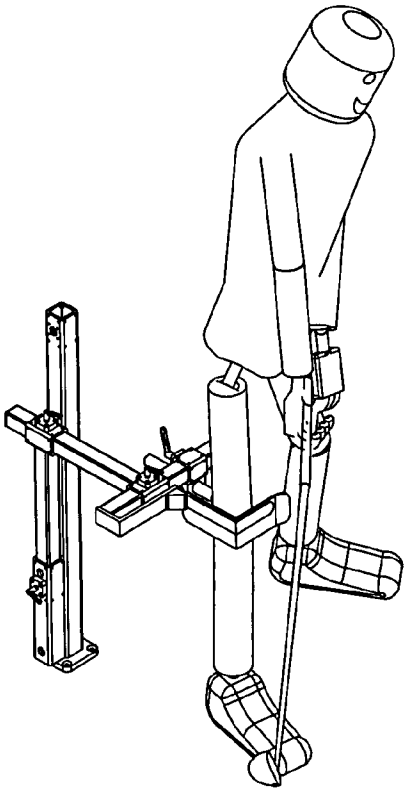
FIG. 4B is a perspective view of the apparatus of FIG. 4A and further includes a model golfer to demonstrate use of the apparatus.
Figure 4A:
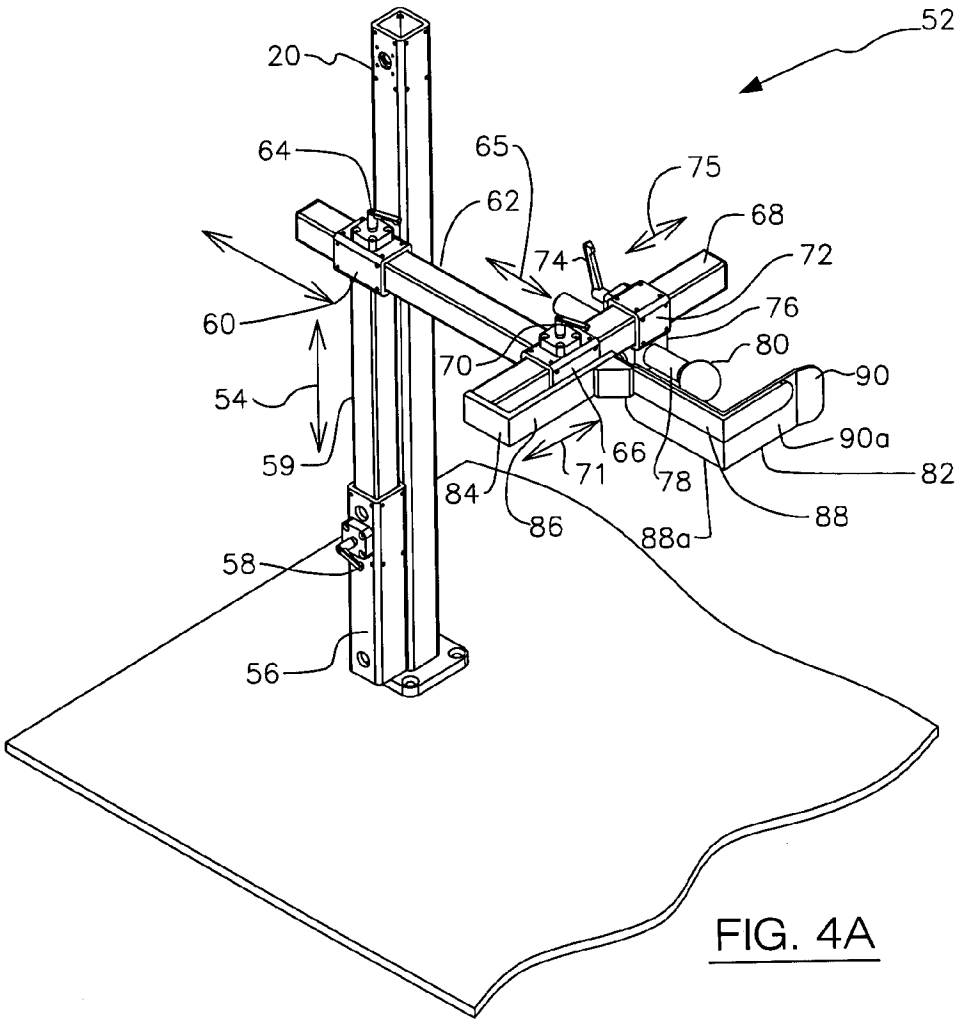
FIG. 4A is a perspective view of the apparatus that stabilizes the right knee of a right-handed golfer or the left knee of a left handed golfer.

Dominant knee stabilizer apparatus 52 is depicted in FIGS. 4A and 4B in connection with a golfer whose dominant side is the right side. Support post 20 from spine stabilizer and head freezer 18 may be left in place as depicted and used as an additional support means. (Looks to me that support post 20 adds nothing; why is it included?) Upstanding height-adjustment post 54 is lockable in an infinite plurality of positions of functional adjustment with respect to hollow channel member 56 by hand-operated locking means 58. Double-headed directional arrow 59 indicates the telescopic movement of upstanding height-adjustment post 54 with respect to hollow channel member 56.

Hollow channel 60 is horizontally and transversely disposed and surmounts post 54. Hollow channel 60 slideably receives transversely disposed depth-adjustment post 62 and hand-operated locking means 64 enables locking of depth-adjustment post 62 in an infinite plurality of positions of functional adjustment relative to hollow channel 60. Double-headed directional arrow 65 indicates the movement of depth-adjustment post 62 with respect to hollow channel 60.

Truncate hollow channel member 66 is secured to the leading end of depth-adjustment post 62 at a right angle thereto. Width-adjustment post 68 is slideably received therewithin and is lockable in an infinite plurality of positions of functional adjustment by hand-operated locking means 70. Double-headed directional arrow 71 indicates the telescopic movement of width-adjustment post 68 with respect to hollow channel member 66.

Truncate hollow channel member 72 is slideably mounted on width-adjustment post 68 and is lockable along the length thereof in an infinite plurality of positions of functional adjustment by hand-operated locking means 74. Double-headed directional arrow 75 indicates the longitudinal movement of hollow channel member 72 with respect to width-adjustment post 68.

Planar mounting plate 76 depends from hollow channel 72 and provides support for support pole 78 that extends therefrom in a transverse plane. In one embodiment, a ball or spherical member 80 may be mounted to the free end of support pole 78 and abuts the posterior side of the golfer's dominant knee joint when the apparatus 52 is in use.

With continued reference to FIG. 4A bracket 82 having three (3) ninety-degree (90°) bends formed therein is secured to a leading end of width-adjustment post 68. First section 84 of bracket 82 extends in a transverse direction and second section 86 extends longitudinally in a direction towards the center of width-adjustment post 68. Third section 88 extends transversely in a leading direction in parallel relation to support pole 78 and abuts the dominant side of the golfer's dominant knee when the apparatus 52 is in use and is thus understood to provide a side barrier wall. Fourth section 90 extends longitudinally in the same direction as second section 86 and abuts the anterior of the golfer's dominant knee when said apparatus is in use and is thus understood to provide a front barrier wall. The space between spherical member 80 and fourth section 90 is sufficient to accommodate the right knee of a right-handed golfer or the left knee of a left-handed golfer.

Three functions are performed by the dominant knee stabilizer apparatus 52, as further described with reference to FIG. 4B and continued reference to FIG. 4A. By way of example with a right-side dominant golfer, the ninety-degree bend between sections 88 and 90 serves to lock the right knee in place so that it cannot move laterally to the right during a back swing. This function is accomplished by positioning the spherical member 80 directly behind the knee joint and bracket section 88 on the right side of the knee. The second function may be performed using an adjustable spherical member or sphere 80 that fits directly behind the knee in the joint that is formed when a golfer takes a stance. A preferred angle for the right knee to be bent is twenty degrees (20°) from the vertical or one hundred ten degrees (110°) measured from a horizontal plane. The position of the sphere 80 ensures that this angle will be maintained throughout the swing. The light pressure applied to the joint by the sphere 80 will cause the golfer to lose balance if an effort is made to straighten the joint during the swing. The third function is performed by bracket section 90, 90*a* that is positioned in front of the knee. It constrains the knee against moving perpendicular (transversely) to the target line but allows the knee to move toward the target in parallel relation (longitudinally) to the target line. Such constriction of the movement of the dominant knee solves many well known swing-related problems.

A third apparatus 94, herein referred to as anti-lift pole, is described with reference to in FIGS. 5A and 5B and includes a "T"-shaped support that overlays base 12. The "T"-shaped support includes transversely disposed part 96 and longitudinally disposed part 98. The depth of the apparatus 94 is adjustable as denoted by double-headed directional arrow 97.

A first square "U"-shaped channel 100 slideably engages a first end of part 98 and a second square "U"-shaped channel 102 slideably engages a second end of part 98. The former is lockable in a plurality of positions of functional adjustment along a first extent of part 98 by hand-operated locking means 101 and the latter is lockable in a plurality of positions of functional adjustment along a second extent of part 98 by hand-operated locking means 103. This enables adjustment of the longitudinal spacing, or width, between the two poles, disclosed hereinafter.

Mounting bracket 104 is secured to channel 100 in upstanding relation thereto and has arcuate slot 106 formed therein. Mounting bracket 108 is secured to channel 102 in upstanding relation thereto and has arcuate slot 110 formed therein. Elongate hollow channel 112 is pivotally mounted at its lowermost end to mounting bracket 104. Guide rod 114 is secured to elongate channel 112 just above the lowermost end and extends longitudinally therefrom, extending through arcuate slot 106.

Elongate hollow channel 116 is pivotally mounted at its lowermost end to mounting bracket 108. Guide rod 118 is secured to elongate channel 116 just above said lowermost end and extends longitudinally therefrom, extending through arcuate slot 110.

Pole 120 is telescopically received within elongate channel 112 and is lockable in an infinite or plurality of positions of functional adjustment by hand-operated locking means 122. Pole 124 is telescopically received within elongate channel 116 and is lockable in an infinite or plurality of positions of functional adjustment by hand-operated locking means 126. Poles 120 and 124 are thus positionable along the arcuate paths of travel denoted by double-headed directional arrows 121 and 125, respectively, and are height-adjustable as indicated by double-headed directional arrows 123, 127, respectively.

Poles 120 and 124 may be used independently of one another or in conjunction with one another. The pole on the left side of a right-handed golfer (in this case, pole 120) also serves as a holder for an adjustable foam-covered arm that serves as a barrier to work on moving the hands left after impact as will be later described in one preferred embodiment of this invention.

Figure 5B:
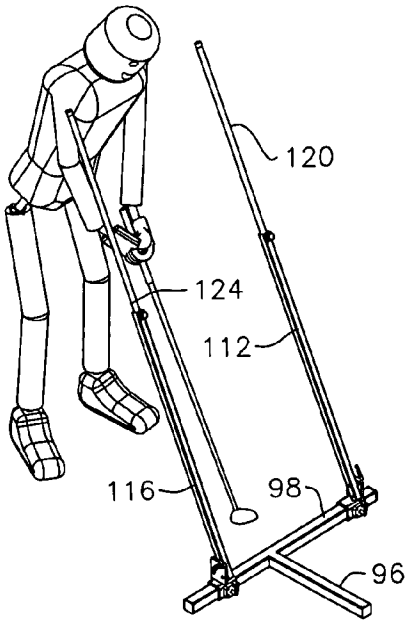
FIG. 5B is a perspective view of the apparatus of FIG. 5A and further includes a model golfer to demonstrate use of the apparatus.
Figure 5A:
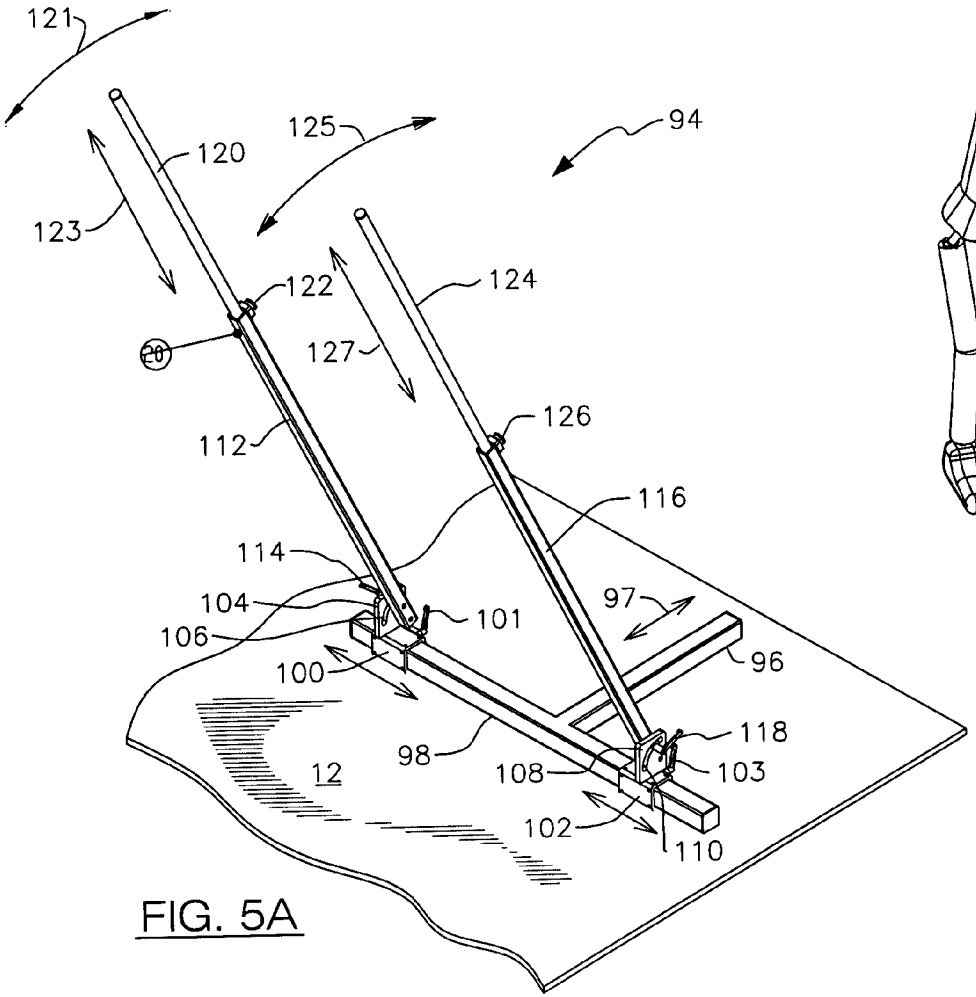

By way of example, a golfer takes the address position as depicted in FIG. 5B and the pole or poles 120, 124 are angled so that their respective free ends are positioned just above the golfer's shoulders. The poles 120, 124 serve as a barrier to train the golfer not to lift his or her arms too high during the back swing and follow-through. It is desirable to keep the arms moving at ninety degrees (90°) to the spine during the top and follow-through parts of the golf swing. Many golfers use the pole 124 on the right side or back swing side. A more experienced right-handed playerwill use the pole 120 on the left side.

A fourth apparatus, an anti-slide wave apparatus is denoted 128 as illustrated with reference to FIGS. 6A and 6B includes an upstanding support post 130 is a hollow channel member. Flange 131 formed at its lowermost end facilitates its attachment to the base 12. Hollow channel member 132 is telescopically received within upstanding support post 130 and is lockable in a plurality of positions of functional adjustment relative there to by hand-operated locking means 134. Double-headed directional arrow 135 indicates the height adjustment made possible by this telescoping arrangement.

Truncate hollow channel member 136 surmounts hollow channel member 132 and is disposed in a horizontal plane in transverse alignment relative to the golfer. Horizontal, transversely disposed hollow channel member 138 is slideably received within hollow channel member 136 and is lockable relative thereto in an infinite number of positions of functional adjustment by hand-operated locking means 140. Double-headed directional arrow 141 indicates the depth adjustment made possible by this arrangement of parts.

Longitudinally disposed truncate hollow channel member 142 is secured to the leading end of transversely disposed hollow channel member 138 and slideably receives longitudinally disposed hollow channel member 144 which is lockable into an infinite plurality of positions of functional adjustment relative to hollow channel member 142 by hand-operated locking means 146. Double-headed directional arrow 147 indicates the width adjustment made possible by this arrangement of parts.

Figure 6B:
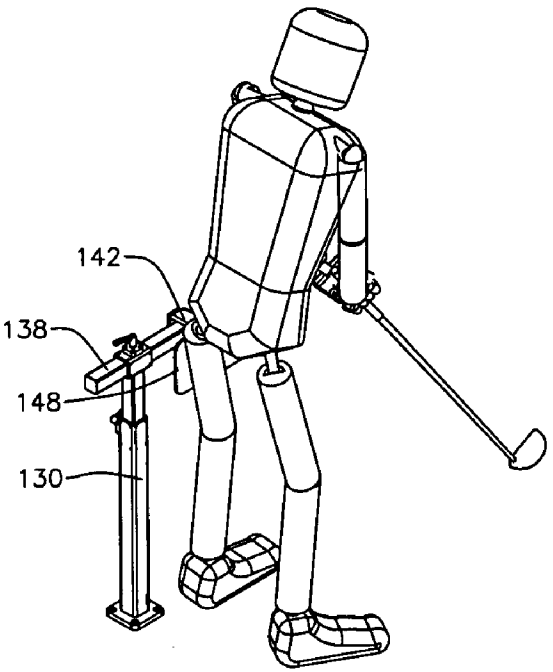
FIG. 6B is a perspective view of the apparatus of FIG. 6A and further includes a model golfer to demonstrate use of the apparatus.
Figure 6A:
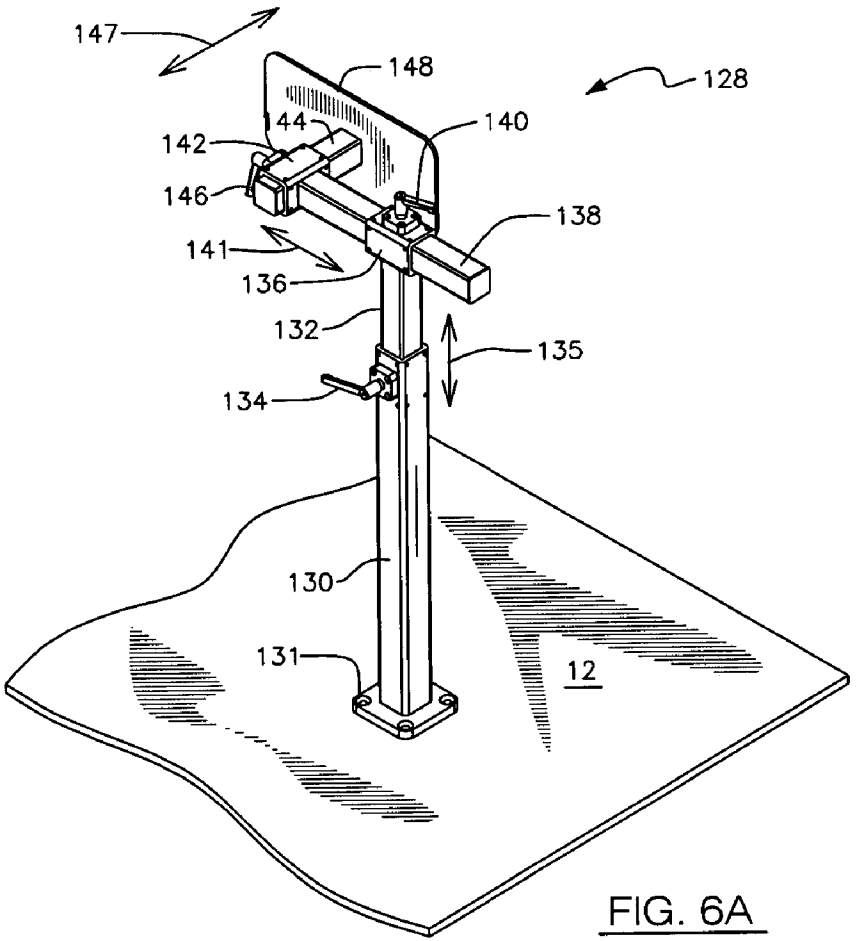
FIG. 6A is a perspective view of the apparatus that teaches a golfer not to shift his or her body toward the target during the forward motion of the swing.

Planar anti-slide wall 148, preferably formed of aluminum, is secured to an inboard end of hollow channel member 144 and is transversely disposed relative to the target line as best understood in connection with FIG. 6B. As used herein, the term "inboard" refers to the side of a part where a golfer is positioned.

As best understood in conjunction with FIG. 6B, anti-slide wall 148 is positioned to the left and behind a right-handed golfer. When adjusted properly, anti-slide wall 148 is positioned a few inches from the golfer's left hip at the golfer's address position. As the golfer makes his or her swing, anti-slide wall 148 serves as a barrier that prevents the body from shifting or sliding too far to the left during the forward motion of the swing. This makes the swinging motion more rotary, as distinguished from linear. This also helps to prevent the golfer's spine angle from increasing due to an over-sliding of the lower body during the down swing. Anti-slide wall 148 not only prevents sliding but also causes a right-handed golfer to shift his or her weight to the left side at the finish of the swing. Thus, the left leg of a right-handed golfer abuts anti-slide plate 148 at the finish of the swing. Generically, the non-dominant leg of a golfer abuts anti-slide plate 148 at the conclusion of a golf swing.

Take away "perfectoer" apparatus 150, depicted in FIGS. 7A and 7B, includes a height-adjustable vertical rod 152 that is positioned just inside the stance line of a golfer, as illustrated with reference to FIG. 7B. When adjusted appropriately, by a golf-teaching professional by way of example, rod 152 serves as a barrier that does not allow the club head to travel back too far inside the original plane line that is parallel to the target line. Thus, rod 152 serves as a barrier or a negative feedback means if the club head comes into contact with it. Take-away perfecter apparatus 150 further includes a built-in safety feature that enables rod 152 to move if struck. If the player's club head misses rod 152 on the take-away, a desired on-plane take-away is achieved.

Rod 152 is hollow and telescopically receives extension rod 154. Double-headed directional arrow 155 indicates the extension and retraction capabilities of extension rod 154 relative to rod 152. Annular collar 156 slideably receives rod 152 and enables height-adjustment of said rod 152 as indicated by double-headed directional arrow 155. Rod 152 is also rotatable within collar 152 as indicated by circular double-headed arrow 157.

A collar 156 is engaged by engagement member 158 that may include a hand-operated locking means 160. Rod 152 is thus adjustable in an infinite plurality of vertical positions of functional adjustment relative to said engagement member 158 as indicated by double-headed directional arrow 161.

Figure 7B:
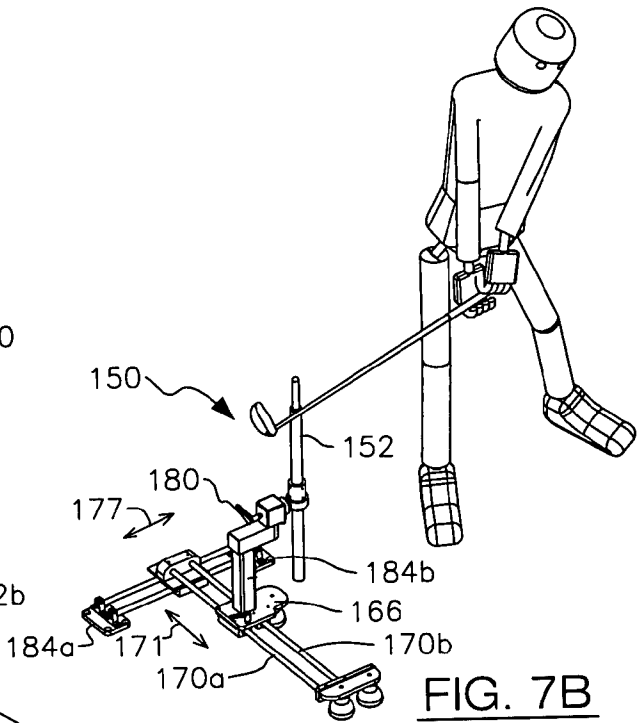
FIG. 7B is a perspective view of the apparatus of FIG. 7A and further includes a model golfer to demonstrate use of the apparatus.
Figure 7A:
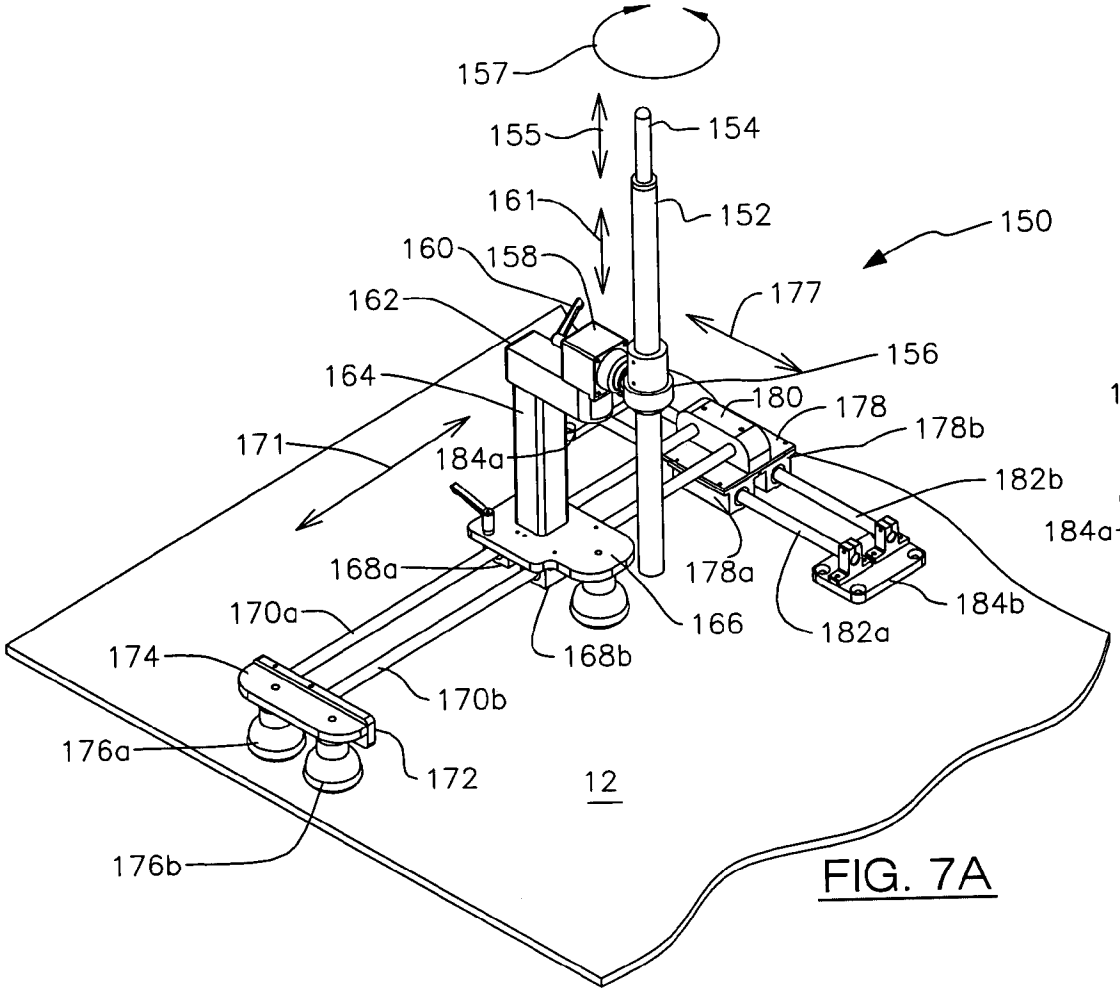
FIG. 7A is a perspective view of an apparatus that teaches a golfer how to perform an on-plane take-away.

With continued reference to FIG. 7A, engagement member 158 is mounted atop horizontally and transversely disposed mounting member 162 that surmounts upstanding post 164. Planar plate 166 is the mounting surface that supports upstanding post 164. Guide blocks 168*a*, 168*b* are formed on the underside of planar plate 166 and each guide block is bored to slidingly receive longitudinally disposed guide rods 170*a*, 170*b*, respectively. Accordingly, planar plate 166 and hence vertical rod 152 are movable along the extent of said guide rods in the directions indicated by double-headed directional arrow 171.

Respective first ends of guide rods 170*a*, 170*b* are mounted to vertical plate 172 which is fixedly secured to transversely disposed horizontal plate 174 from which depends a pair of caster wheels 176*a*, 176*b*, or other suitable wheel. Wheels 176*a*, 176 enable guide rods 170*a*, 170*b*, and hence upstanding rod 152, to be transversely displaced relative to base 12 as indicated by double-headed directional arrow 177.

Transversely disposed guide block 178 supports mounting block 180 which is suitably bored to receive the opposite ends of guide rods 170*a*, 170*b*. A pair of guide members 178*a*, 178*b* are formed integrally with guide block 178 on the underside thereof and said guide members are bored to slideably receive guide rods 182*a*, 182*b*. The opposite ends of guide rods 182*a*, 182*b* are secured to mounting members, 184*a*, 184*b* that are securely mounted to base 12. This assembly cooperates with wheels 176*a*, 176*b* to enable displacement of guide rods 170*a*, 170*b* along the extent of guide rods 182*a*, 182*b*.

Figure 8B:
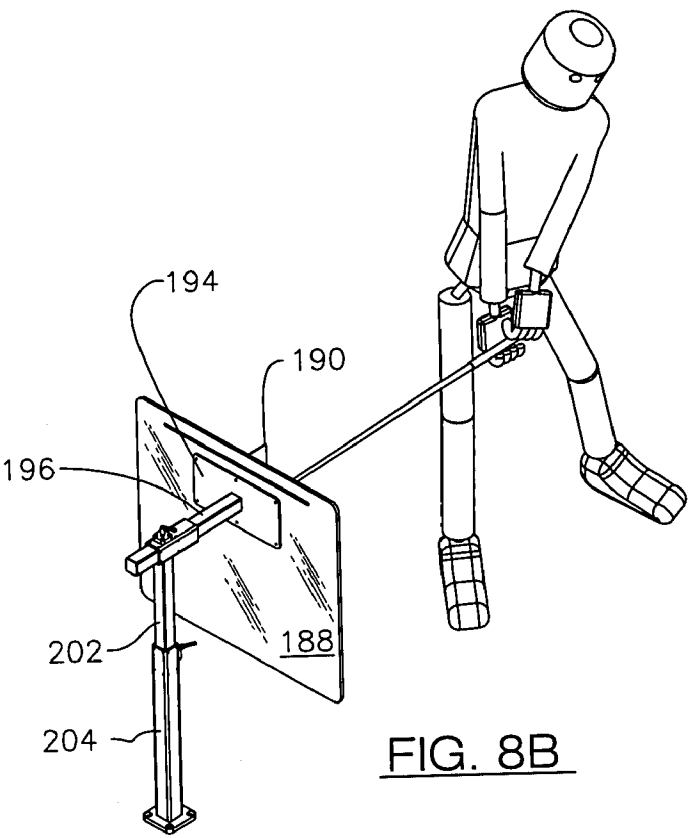
FIG. 8B is a perspective view of the apparatus of FIG. 8A and further includes a model golfer to demonstrate use of the apparatus.
Figure 8A:
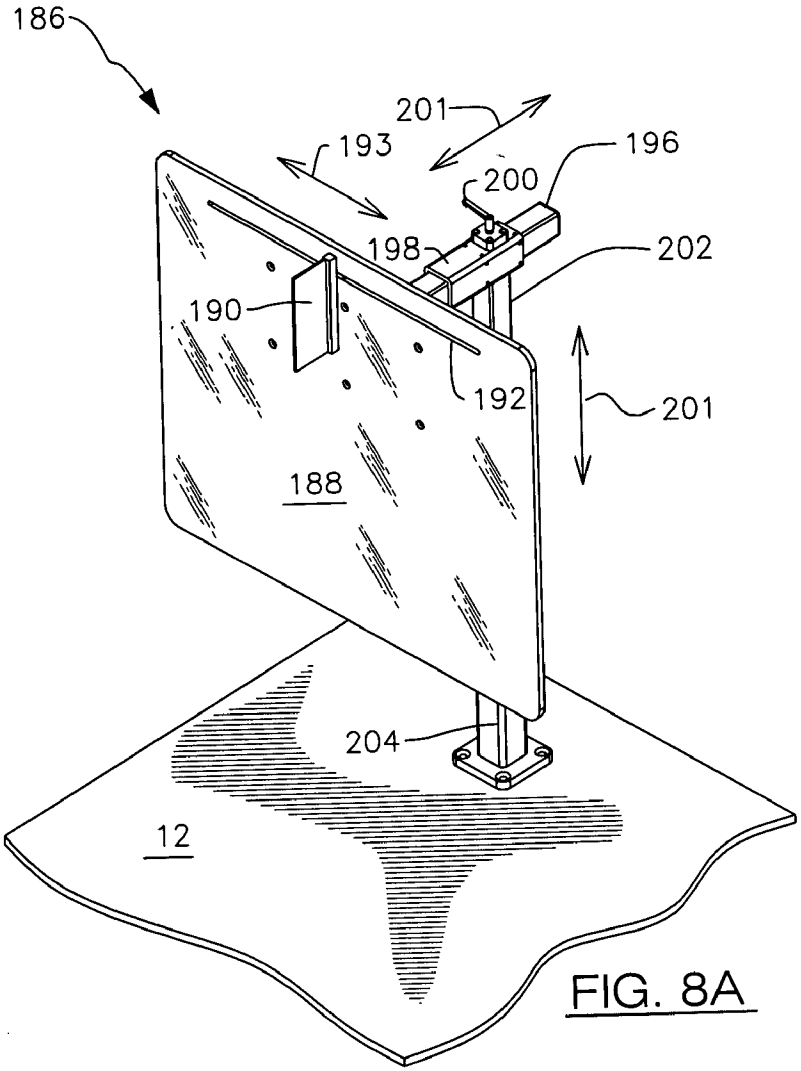
FIG. 8A is a perspective view of an apparatus that teaches a golfer to hinge a club properly by the wrists.

A sixth apparatus, the pre-set wall assembly apparatus 186 is depicted in FIGS. 8A and 8B. Pre-set wall 188 is a large, square piece of transparent material positioned in longitudinally spaced relation behind the golfer as depicted in FIG. 8B. As used herein, "behind" means the side of the golfer away from the target hole. Pre-set wall 188 provides a transversely disposed barrier against which the club will strike if said club is not hinged properly, i.e., in an optimal manner, by the wrists. Longitudinally disposed flap 190 is disposed at a ninety-degree (90°) angle to the pre-set wall 188 and is slideably adjustable in position along the transversely-disposed extent of slot 192 as indicated by double-headed directional arrow 193.

The flap 190, when optimally positioned relative to the golfer, by a golf instructor, by way of example, serves as a barrier that does not allow the golfer to take the club head too far inside or behind him or her during the take-away part of a golf-swing.

The pre-set wall 188 is transparent to enable a video recording to be taken through said wall during the swing from behind the golfer while still being able to see the club shaft and club head.

Hinging the wrist at the proper time in the back swing enables the golfer to make a correct turn of the upper body in conjunction with the arms.

The pre-set wall 188 also serves as a holder for a foam covered shaft that is used for the hands as will later be described with reference to FIGS. 9A and 9B. When pre-set wall 188 is in its optimal position, it provides a barrier that the hands must stay under on the back swing and on the down swing.

The transparent pre-set wall 188 is mounted on a planar opaque metallic or plastic mounting surface 194 (FIG. 8B) and is secured to the end of horizontally and longitudinally disposed channel member 196 which is slideably received within truncate hollow channel member 198. Accordingly, the channel member 196 is positionable in an infinite plurality of positions of functional adjustment relative to the truncate hollow channel member 198 and is lockable in any of those positions by hand-operated locking means 200. Double-headed directional arrow 201 indicates such adjustability.

Telescoping tube 202 that is telescopically received within upstanding hollow support post 204 provides height-adjustability of pre-set wall 188, indicated by double-headed directional arrow 201.

Figure 9B:
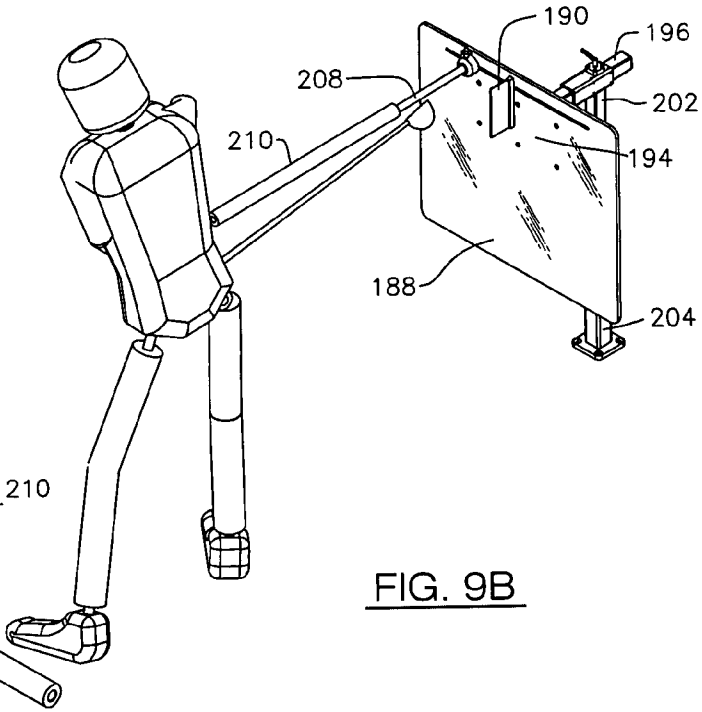
FIG. 9B is a perspective view of the apparatus of FIG. 9A and further includes a model golfer to demonstrate use of the apparatus.
Figure 9A:
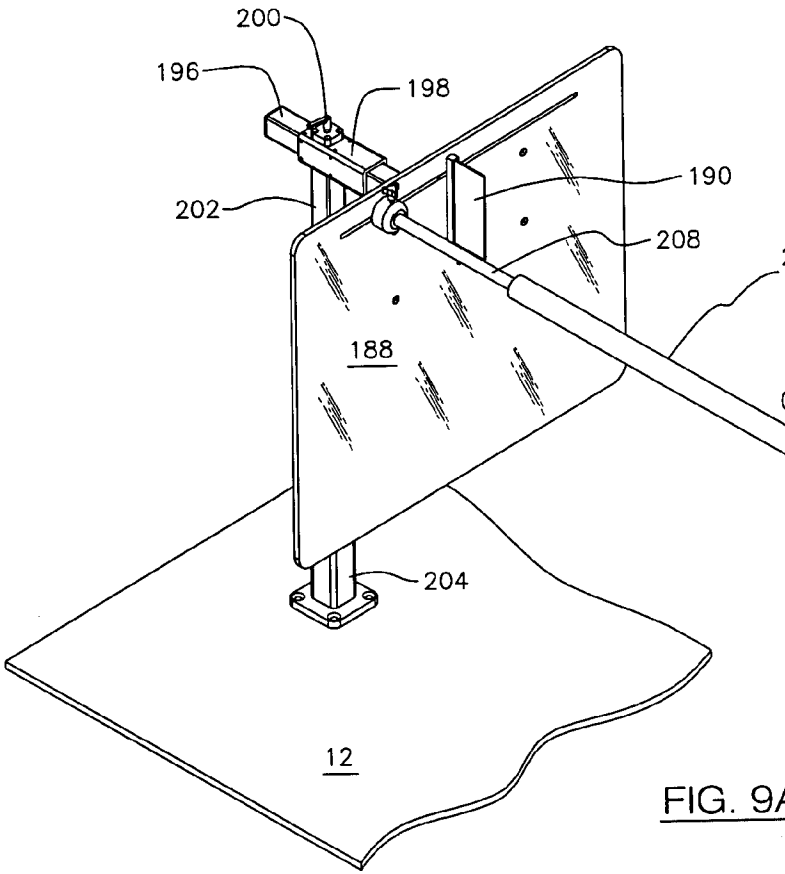
FIG. 9A is a perspective view of an apparatus that allows the hands to move inside an ideal swing plane on the take-away and to prevent the hands from moving too far out of said ideal swing plane on the down swing.

The seventh apparatus is depicted in FIGS. 9A and 9B expands upon the description illustrated with reference to FIGS. 9A and 9B and is denoted 206 as a whole. Hand plane bar apparatus 206 connects to pre-set wall 188. It includes rod 208 that extends in a longitudinal direction, i.e., toward the golfer. Soft foam extension 210 is adjusted so that it hangs just over the hands of the golfer at address. Thus, only the hands can move inside on the take-away. The device further serves to keep the hands from moving too far out in the downswing. Accomplished players will generally use the hand plane bar apparatus 206.

Figure 10B:
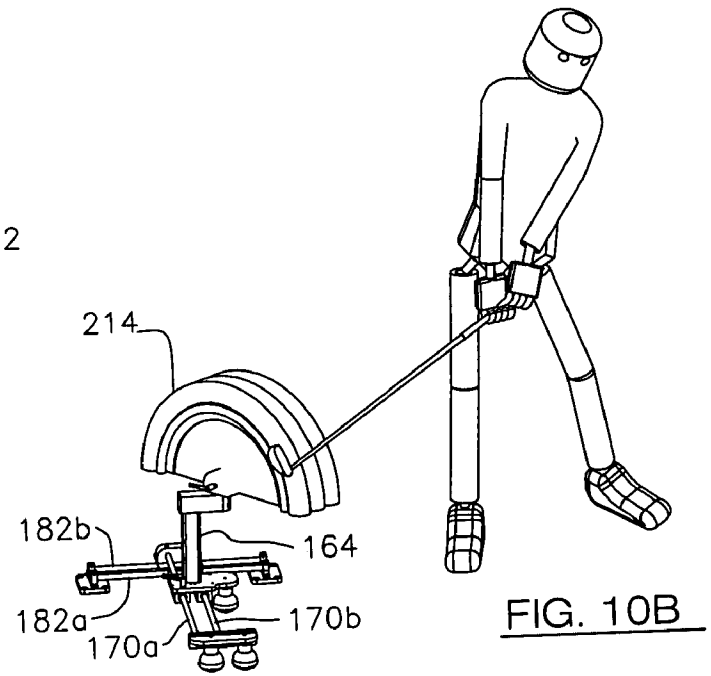
FIG. 10B is a perspective view of the apparatus of FIG. 10A and further includes a model golfer to demonstrate use of the apparatus.
Figure 10A:
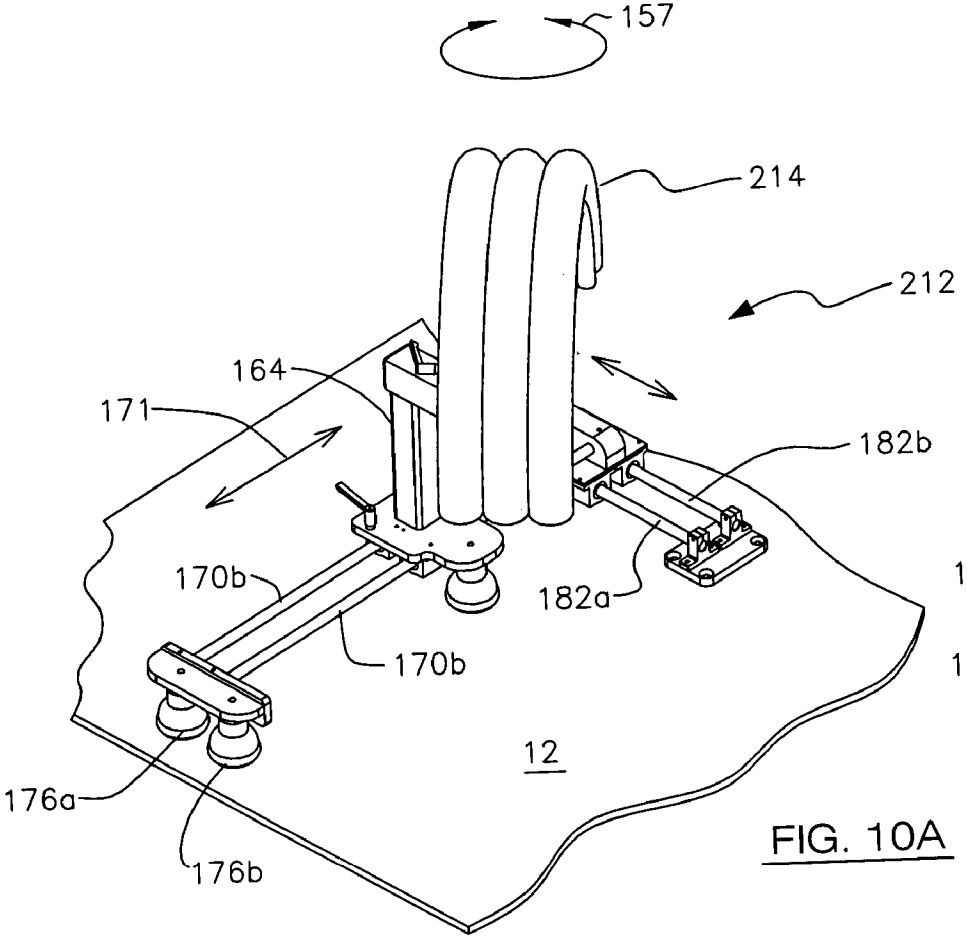
FIG. 10A is a perspective view of the apparatus that teaches a correct take-away and downswing.

FIGS. 10A and 10B depict a "tire styled " take away downswing apparatus 212 that includes a piece of equipment 214 that resembles half of a vehicular tire and herein referred to as arcuate or optionally hemispherical barrier 214 positioned at a predetermined optimal angle relative to the target line, and is generally positioned one club length back (longitudinally) from the golfer as best understood in connection with FIG. 10B. This structure teaches at least two aspects of a golf stroke. First, it teaches correct take-away. If the club head is pulled inside, it will hit tire 214, thereby providing negative feedback. The club head passes over the tire 214 when an optimal take-away is performed, for example when the golfer keeps the club head on plane and outside the hands. Secondly, on the down swing, the tire 212 provides a barrier that is struck unless the golfer performs a down swing with a shallow angle of approach. The depicted severe angle of approach (FIG. 10B) from the inside is herein illustrated as an exaggeration, but necessary to groove a more correct down swing plane especially for some one whose problem is a deep downswing.

The structure that enables re-positioning of apparatus 212 relative to base 12 is substantially the same apparatus used in take-away perfector 150 (FIGS. 7A and 7B). Accordingly, the same reference numerals have been applied thereto. Hemispherical barrier tire 214 is pivotally mounted for rotation about a vertical plane so that its angular relation to the target line is adjustable. Double-headed directional arrow 157 indicates such pivotal mounting.

Figure 11B:
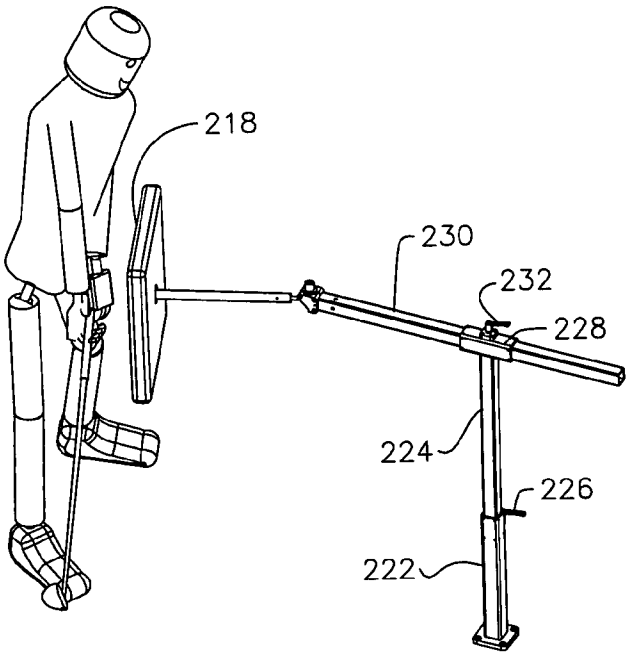
FIG. 11B is a perspective view of the apparatus of FIG. 11A and further includes a model golfer to demonstrate use of the apparatus.
Figure 11A:
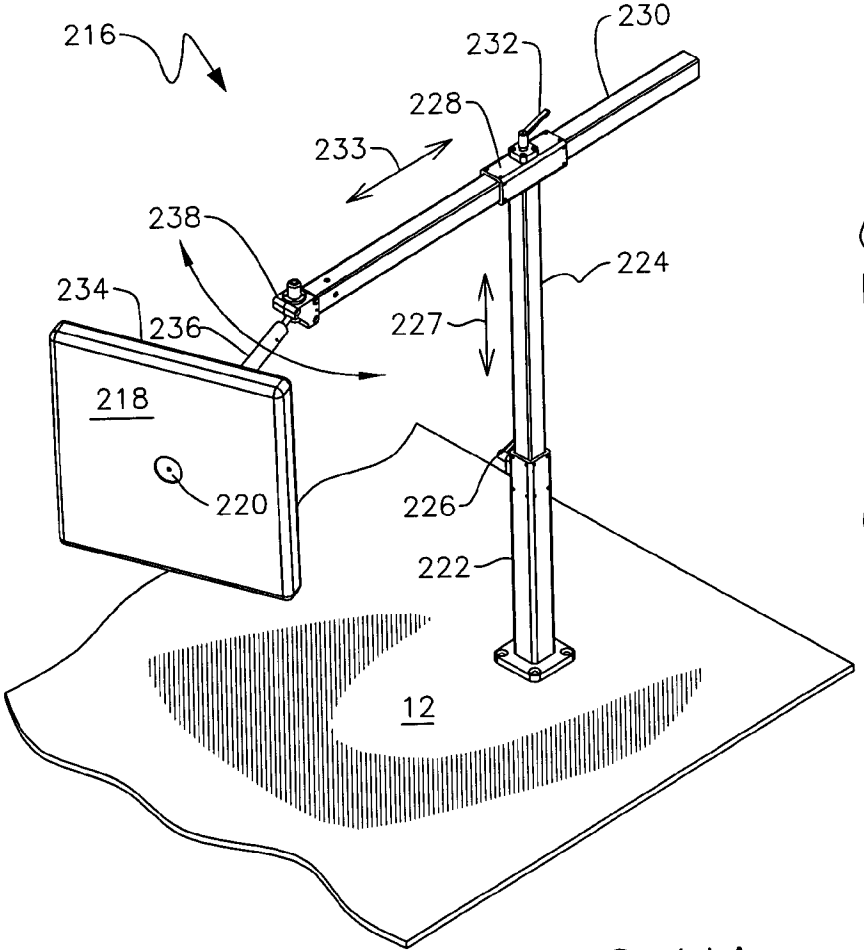
FIG. 11A is a perspective view of the apparatus that teaches a golfer's hands to travel on an optimal path on the back swing and the down swing.

Apparatus 216, depicted in FIGS. 11A and 11B, is herein referred to as the insider apparatus and includes an adjustable arm 230 that is placed about forty five degrees (45°) relative to the golfer's right shoulder and the target line as best understood in connection with FIG. 11B. The insider apparatus 216 includes a covered foam pad 218 that is preferably about eighteen inches by eighteen inches square (18"×18" in$^2$). The edge of the pad 218 is about three to four inches (3"–4") from the golfer's right shoulder. The pad 218 forces the golfer's hands to travel on an optimal path on the back swing and especially on the downswing. The cushioned pad 218 may be equipped with a ball attachment mechanism 220 that allows the pad to break away if accidentally struck on the down swing. No part of the apparatus 216 should be struck during the entire swing. Use of the apparatus 216 is very effective in stopping an inside to outside swing path, a common problem in golf.

The structure of the apparatus 216 is herein further detailed and includes a height-adjustability of foam pad 218, indicated by double-headed directional arrow 227, is provided by tube 224 that is telescopically received within upstanding hollow support post 222. Hand-operated locking means 226 locks tube 224 into any preselected position of functional adjustment relative to hollow support post 222. Transversely disposed truncate hollow tube 228 surmounts tube 224 and slideably receives horizontally disposed elongate channel member 230. Hand-operated locking means 232 locks channel member 230 into an infinite plurality of positions of functional adjustment relative to truncate hollow tube 228, as indicated by double-headed directional arrow 233 in FIG. 11A.

Foam pad 218 is secured in overlying relation to support base 234 that may be connected to swivel arm 236 by the above-mentioned releasable ball attachment 220. The proximal end of swivel arm 236 is engaged for pivotal movement by hinge 238 that may be secured to the distal end of hollow channel member 230.

Figure 12B:
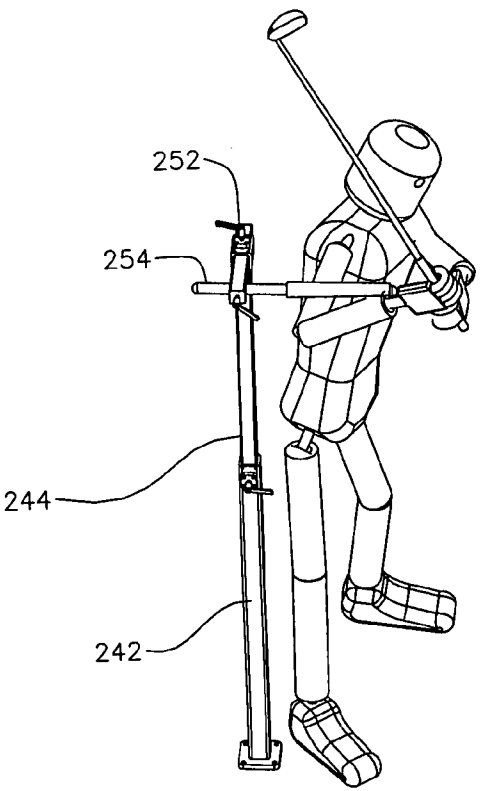
FIG. 12B is a perspective view of the apparatus of FIG. 12A and further includes a model golfer to demonstrate use of the apparatus.
Figure 12A:
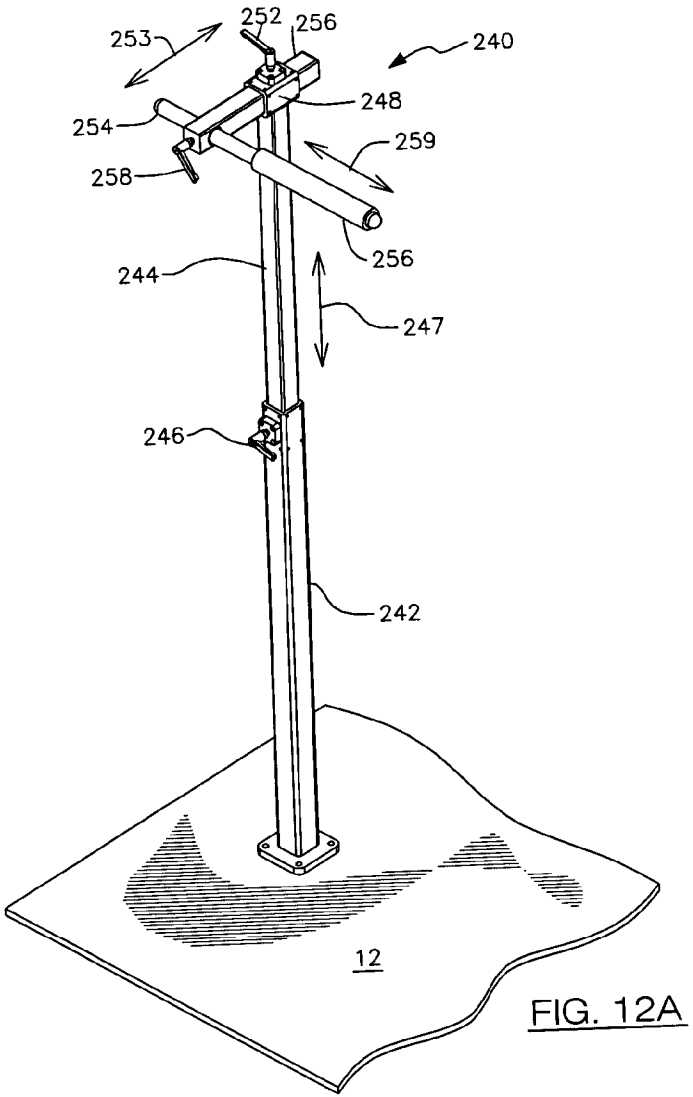
FIG. 12A is a perspective view of the apparatus that limits the length of the golfer's back swing.

The tenth apparatus 240 is depicted in FIGS. 12A and 12B To be herein referred to as the super width producer, apparatus 240 is positioned behind and to the right of a right-handed golfer as depicted in FIG. 12B. It is adjustable up and down as well as toward and away from the golfer, depending upon the size of the golfer. Apparatus 240 limits the length of a golfer's back swing by serving as a barrier if the right elbow of a right-handed golfer folds or bends more than ninety degrees (90°).

More specifically, the apparatus 240 includes a padded arm 256 that serves as a barrier and provides negative feedback if a right-handed golfer over-folds his or her right arm or tries to take the club too far back. Use of apparatus 240 is useful for the golfer to maintain a consistent radius for the hands and the proper width.

The structure of apparatus 240 may be herein described to include the base 12 that supports upstanding hollow channel member 242 that telescopically receives hollow channel member 244. Hand-operated locking means 246 locks hollow channel member 244 into an infinite plurality of positions of functional adjustment relative to hollow channel member 242, as indicated by double-headed directional arrow 247. Horizontally and longitudinally disposed truncate hollow channel member 248 surmounts hollow channel member 244 and slideably receives hollow channel member 250. Hand-operated locking means 252 locks hollow channel member 250 into an infinite number of positions of functional adjustment relative to truncate hollow channel member 248, as indicated by double-headed directional arrow 253. The distal end of hollow channel member 250 has a transversely disposed throughbore formed therein that slidingly accommodates arm 254 having padding 256. Hand-operated locking means 258 locks arm 254 into an infinite plurality of positions of functional adjustment relative to hollow channel member 250, as indicated by double-headed directional arrow 259.

Figures 13A, 13B:
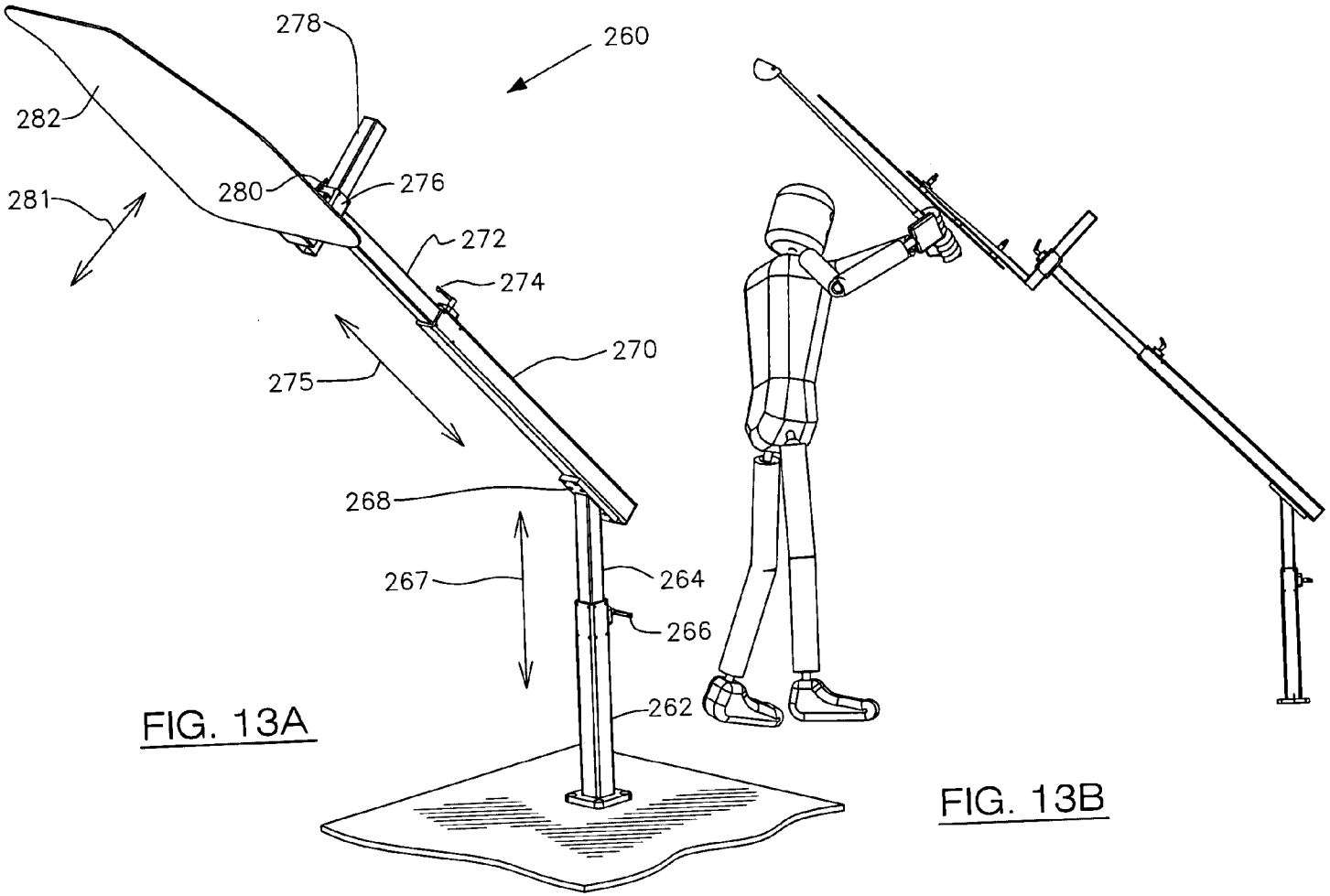
FIG. 13A is a perspective view of the apparatus that teaches the correct position of the arms and the club shaft at the top of a golf swing.
FIG. 13B is a perspective view of the apparatus of FIG. 13A and further includes a model golfer to demonstrate use of the apparatus.

The next apparatus, herein referred to as an on-plane apparatus 260 is depicted in FIGS. 13A, 13B and is denoted 260 as a whole and may be commercially known as the Plane O Matic™. This apparatus 260 helps teach a golfer the proper (optimal) positioning of the arms and club shaft at the top of the swing. The apparatus 260 provides a barrier that constrains the left arm of a right-handed golfer and the club shaft to be in the preferred "on plane" position at the top of the swing. This is accomplished by an adjustable clear piece barrier 282 that when angled at an optimal angle guarantees that the golfer will adopt this very important position. If the hands, or more importantly, the club shaft, come off the plane at the top of the swing, the club strikes the clear piece. Having the "perfect on plane position at the top of the swing makes it very easy to bring the club down properly.

Base 12 supports upstanding hollow channel member 262 that telescopically receives hollow channel member 264. Hand-operated locking means 266 locks arm hollow channel member 264 into an infinite plurality of positions of functional adjustment relative to hollow channel member 262, as indicated by double-headed directional arrow 267.

The uppermost end of hollow channel member 264 is beveled at about a forty-five degree (45°) angle and mounting plate 268 is secured thereto. Elongate hollow channel member 270 is fixedly secured to said mounting plate 268 and thus is disposed at the same angle. Note that this angle is not adjustable. Hollow channel member 270 telescopically receives hollow channel member 272. Hand-operated locking means 274 locks arm hollow channel member 272 into an infinite plurality of positions of functional adjustment relative to hollow channel ember 270, as indicated by double-headed directional arrow 275.

Truncate hollow channel member 276 is secured to the distal end of hollow channel member 272 and is disposed at a ninety-degree (90°) angle relative thereto. Truncate hollow channel member 276 is therefore disposed at a forty-five degree (45°) angle relative to a horizontal plane. Truncate hollow channel member 276 slideably receives hollow channel member 278. Hand-operated locking means 280 locks hollow channel member 278 into an infinite plurality of positions of functional adjustment with respect to truncate hollow channel member 276, as indicated by double-headed directional arrow 281

Clear piece 282 is secured to the distal end of hollow channel member 278 and is therefore positioned at a forty-five degree (45°) angle relative to a horizontal plane.

Figure 14B:
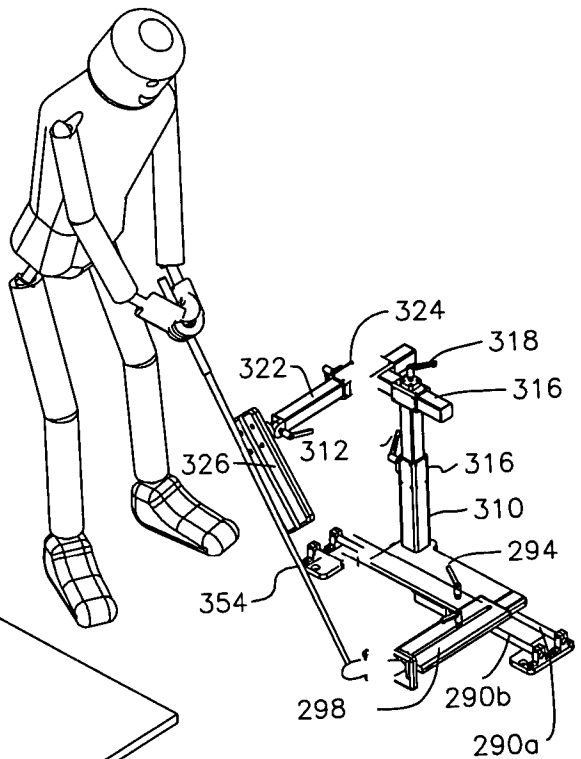
FIG. 14B is a perspective view of the apparatus of FIG. 14A and further includes a model golfer to demonstrate use of the apparatus.
Figure 14A:
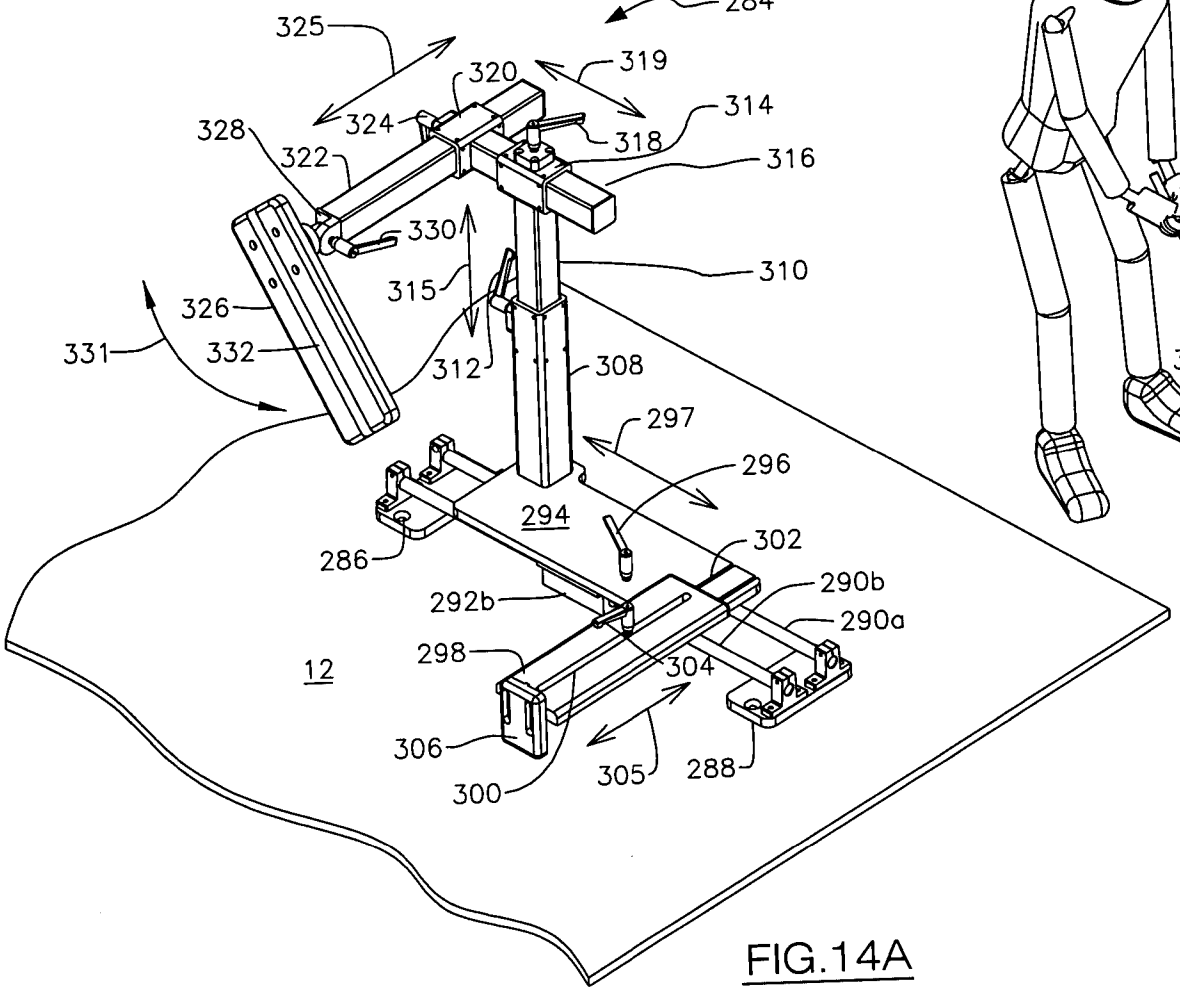
FIG. 14A is a perspective view of the apparatus that teaches where the club head and club shaft should be at the moment of impact.

Turning now to FIGS. 14A and 14B, there it will be seen that impact positioning apparatus 284 teaches a golfer the optimal impact position. This apparatus is useful when training a golfer where the club head and shaft should be positioned at the moment of impact, an important point in the swing. The impact positioning apparatus 284 includes two position-adjustable pieces that conform to an individual's address position. As the golfer swings down into impact, the club head and shaft must preferably contact the two position-adjustable pieces of the apparatus at the same time. Although the golfer may never-actually strike a ball when practicing with the apparatus 284, the repetition and training creates a muscle memory that is carried onto the golf course.

The structure that provides the adjustability for the two pieces includes a pair of transversely spaced apart mounting brackets 286, 288 that are fixedly secured to the base 12. Brackets 286, 288 support the opposite ends of parallel guide rods 290*a*, 290*b* that are slideably engaged by rod-engaging elements 292*a*, 292*b*, only the latter of which is not obscured by support plate 294 with which said rod-engaging elements are integrally formed. Hand-operated locking means 296 locks support plate 294 into an infinite plurality of positions of functional adjustment along the extent of said guide rods, as indicated by double-headed directional arrow 297.

Longitudinally disposed plate 298 has a longitudinally extending groove 300 formed therein that slidingly engages a complementally formed tongue 302 that is formed in support plate 294. Hand-operated locking means 304 locks plate 298 into an infinite plurality of positions of functional adjustment relative to support plate 294, as indicated by double-headed directional arrow 305. Strike plate 306 depends from the distal end of longitudinally disposed plate 298. It is clear that the strike plate 306 is easily moved transversely in or out, i.e., toward or away from the golfer, and longitudinally to the left and right of the golfer as further described with reference to FIG. 14B.

Support plate 294 also supports upstanding hollow channel member 308 that may telescopically receive hollow channel member 310. Hand-operated locking means 312 locks hollow channel member 310 into an infinite plurality of positions of functional adjustment relative to hollow channel member 308, as indicated by double-headed directional arrow 313. Transversely disposed, truncate hollow channel member 314 surmounts hollow channel member 310 and slideably receives hollow channel member 316. Hand-operated locking means 318 locks hollow channel member 316 into an infinite plurality of positions of functional adjustment relative to truncate hollow channel member 314, as indicated by double-headed directional arrow 319.

Longitudinally disposed, truncate hollow channel member 320 is fixedly secured to hollow channel member 316 at a right angle thereto and receives hollow channel member 322. Hand-operated locking means 324 locks hollow channel member 322 into an infinite plurality of positions of functional adjustment relative to truncate hollow channel member 320, as indicated by double-headed directional arrow 325.

Club shaft impact plate 326 is pivotally mounted to the inboard end of hollow channel member 322 by a swivel member 328. Hand-operated locking means 330 locks club shaft impact plate 326 into an infinite plurality of positions of functional adjustment in a vertical plane as indicated by double-headed directional arrow 331. Groove 332 receives club shaft 334 (FIG. 14B) when the golfer is positioned in an optimal position for impact.

Figure 15B:
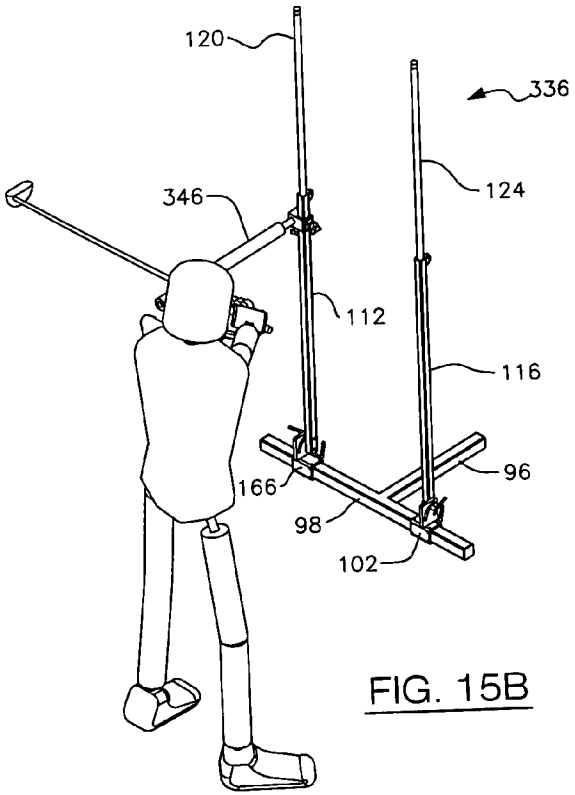
FIG. 15B is a perspective view of the apparatus of FIG. 15A and further includes a model golfer to demonstrate use of the apparatus.
Figure 15A:
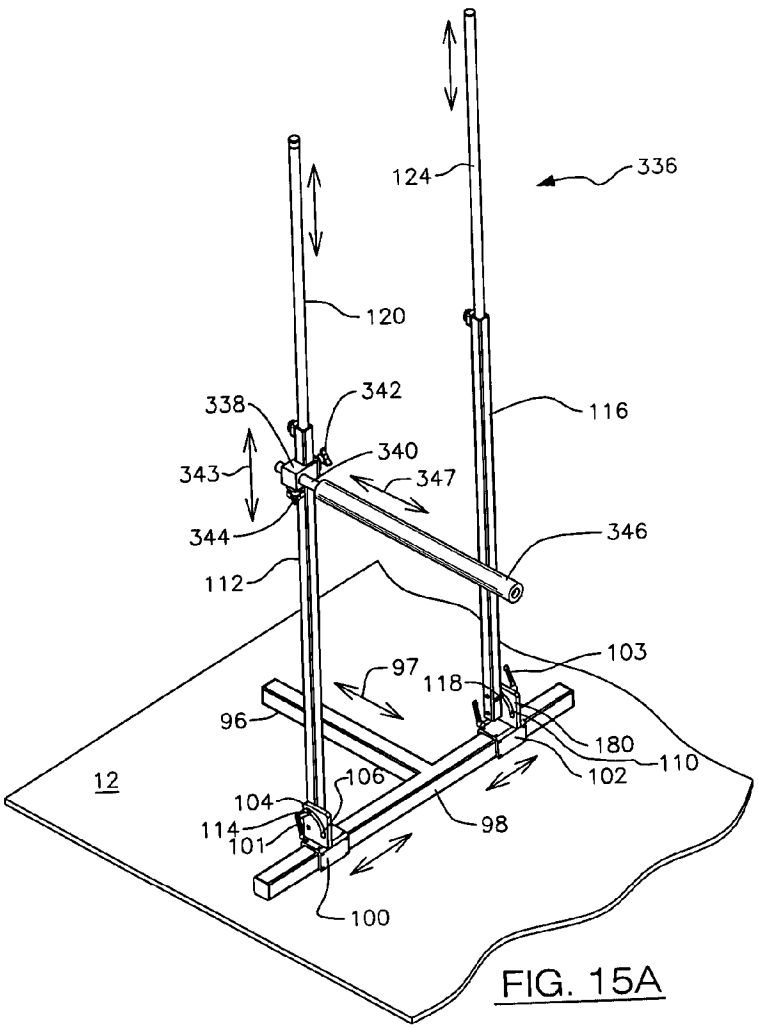
FIG. 15A is a perspective view of the apparatus that teaches a golfer a correct path of travel for the hands after impact.

The next apparatus is known as the advanced follow-through hand perfector apparatus 336 and is denoted in FIGS. 15A and 15B as a whole. The primary structure of the apparatus 336 may use the anti-lift pole apparatus 94 of FIGS. 5A and 5B. Therefore, the common parts thereof have been earlier identified. New mounting member 338 includes a first vertically oriented opening that slideably receives hollow channel member 112 and a second horizontally oriented, transversely disposed opening that receives rod 340. Hand-operated locking means 342 locks mounting member 338 into an infinite plurality of positions of functional adjustment relative to truncate hollow channel member 112, as indicated by double-headed directional arrow 343. Locking means 344 secures rod 340 in nonadjustable relation to mounting member 338, but rod 340 is covered by foam pad 346 that may be adjustable along the length of said rod as indicated by double-headed directional arrow 347 so there is no need to make the position of rod 340 itself adjustable.

As further described with reference to FIG. 15B, rod 340 may be secured to the left anti-lift pole 112 for a right-handed golfer when the pole 120 is in a vertical orientation. Rod 340 extends straight out at a ninety-degree (90°) angle relative to pole 112, i.e., in a horizontal and transversely disposed orientation. Foam pad 346 provides a barrier that the golfer's hands must miss just after the moment of impact. Accordingly, although not required, golfers having advanced skills may generally use the apparatus 336.

Figures 16A, 16B:
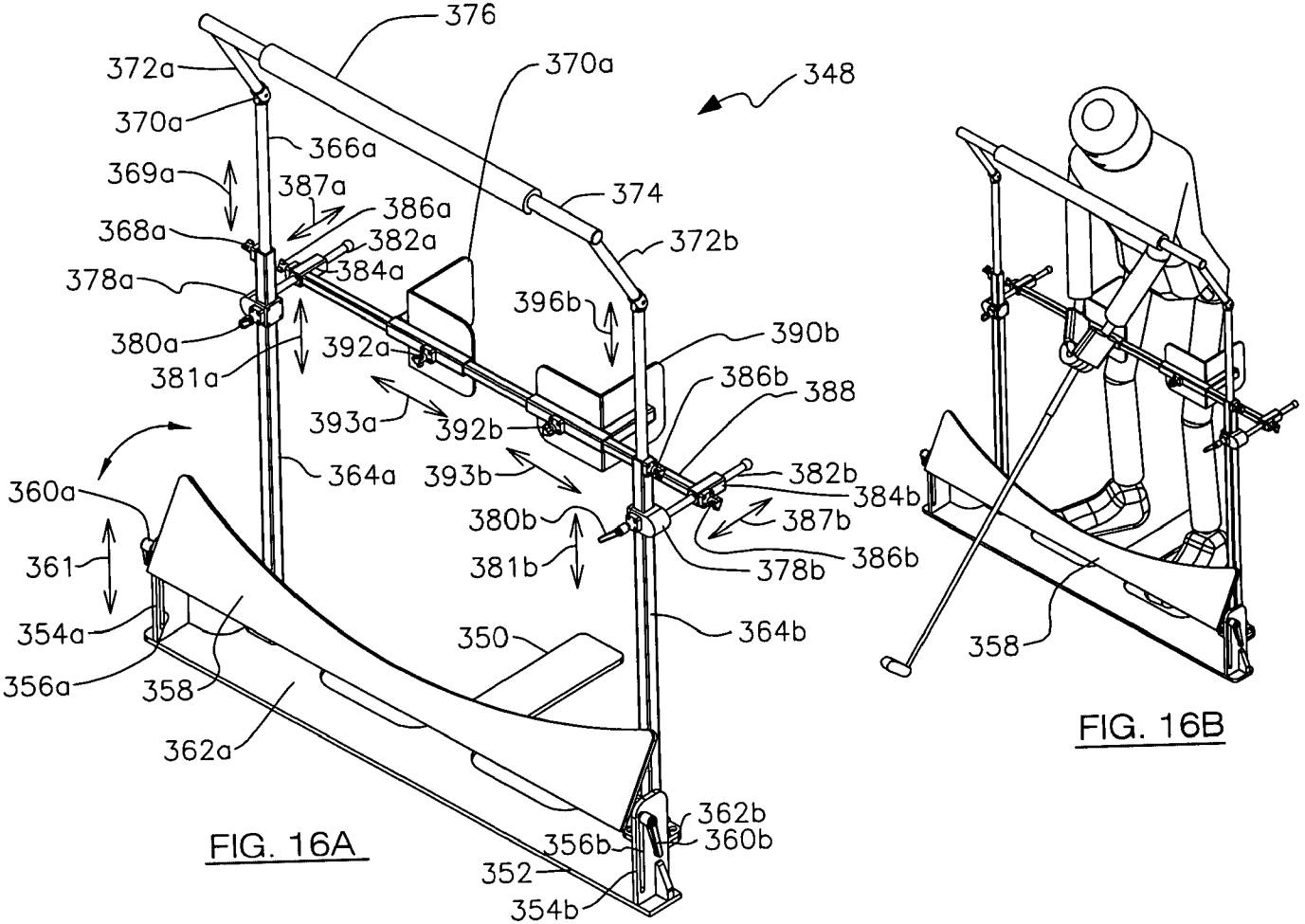
FIG. 16A is a perspective view of the apparatus that teaches proper body positioning for a putting stroke when in a first configuration.
FIG. 16B is a perspective view of the apparatus of FIG. 16A and further includes a model golfer to demonstrate use of the apparatus.

Another apparatus herein described by way of example, is depicted in FIGS. 16A and 16B and is denoted as a whole by the reference numeral 348. Putting apparatus 348 may stand without the base and thus is not herein described as supported by the base 12. It teaches golfers how to stand to perform a preferred putting stroke. Apparatus 348 has a "T"-shaped stand having a transverse part 350 that the golfer straddles as depicted in FIG. 16B and a longitudinal base part 352. Upstanding brackets 354*a* and 354*b* are fixedly secured to longitudinal part 352 at opposite ends thereof and a vertically extending slot 356*a*, 356*b* is formed in brackets 354*a*, 354*b*, respectively. Longitudinally disposed board 358 has pegs at its opposite ends that extend through said vertically extending slots, and hand-operated locking means 360*a*, 360*b* enable said board 358 to be adjustable up and down along the extent of said slots as indicated by double-headed directional arrow 361.

Longitudinal base part 352 includes short, transversely extending parts 362*a*, 362*b* integrally formed at its opposite ends. Upstanding hollow channel members 364*a*, 364*b* are mounted to said parts, respectively. Rods 366*a*, 366*b* are telescopically received within said hollow channel members, and hand-operated locking means 368*a*, 368*b* enable said rods to be positioned at any functional position of adjustment relative to said hollow channel members, as indicated by double-headed directional arrow 369.

Hinges 370*a*, 370*b* interconnect rods 366*a* and 366*b* to rods 372*a*, 372*b* which are interconnected to one another by longitudinally disposed rod 374 which is covered at least in part by a foam pad 376.

Additional hardware is attached to upstanding hollow channel members 364*a*, 364*b*. Brackets 378*a*, 378*b* are infinitely adjustable along the extent of said hollow channel members, and are lockable in any position of functional adjustment by hand-operated locking means 380*a*, 380*b*, respectively, as indicated by double-headed directional arrows 381*a*, 381*b*.

Brackets 378*a*, 378*b* further provide mounts for transversely extending rods 382*a*, 382*b* which serve as the mounts for truncate hollow channel members 384*a*, 384*b* that are slideably mounted along the length of rods 382*a*, 382*b*. Hand-operated locking means 386*a*, 386*b* enable locking of said truncate hollow channel members 384*a*, 384*b* at any position of functional adjustment along the length of said rods 382*a*, 382*b* as indicated by double-headed directional arrows 387*a*, 387*b*.

Hollow channel members 384*a*, 384*b* engage opposite ends of longitudinally disposed mounting bar 388 to which is slideably mounted a pair of knee positioning members that take the form of "L"-shaped brackets 390*a*, 390*b*. Hand-operated locking means 392*a*, 392*b* enable locking of said "L"-shaped brackets 390*a*, 390*b* at any position of functional adjustment along the length of said mounting bar 388 as indicated by double-headed directional arrows 393*a*, 393*b*.

A good set up is required if a golfer is to have good putting mechanics. An embodiment of a putting training apparatus for developing a desired putting stroke includes the apparatus 348 having adjustable knee braces 390*a*, 390*b* to lock the knees and lower body in parallel to the intended line. Foam covered bar 374 adjusts across the shoulders and the shoulders and forearms are positioned parallel thereto.

Methods of using the apparatus 348 may in a first method, a board 358 adjustable to teach a golfer how to perform an arc stroke. When the set up described above is square, the putter shaft is positioned so that it rests atop board 358 as depicted in FIG. 16B. Board 358 is raised and angled to match the angle of the shaft of the putter at address. By keeping the shaft flush with board 358 during the stroke, the putter head will move in an arc. For the straight back straight through stroke, board 358 is positioned straight up and down, i.e., in a vertical plane, and the heel of the putter slides against it during the stroke.

With apparatus as above described, an instructor or golfer may use combinations to improve specific aspects of the golf swing. By way of example, and with reference to FIG. 17, and again to FIGS. 3A, 3B, 4A, 4B, 6A, and 6B, a golf swing training apparatus useful in developing a desired spine angle and shoulder turn may include the horizontally disposed plate 46 positioned in an abutting relation above the head of the golfer prior to making a golf swing and horizontally disposed rod 41 may be carried proximate the horizontally disposed plate 46 in an abutting relation to a dominant temple of the golfer. The golfer maintains contact with the horizontally disposed plate 46 and the horizontally disposed rod 41 during the performance of the golf swing, with a result that the horizontally disposed plate 46 and the horizontally disposed rod 41 provide feedback to the golfer when the head of the golfer changes levels during the swing and moves in relation to the horizontally disposed rod 41. Further, the dominant knee of the golfer, as illustrated with reference again to FIGS. 4A, 4B, and 17, is positioned within a barrier 52. By way of one example of the barrier 52, and with continued reference to FIGS. 4A and 4B, a spherical ball 80 is anatomically positioned in spaced relation with the horizontally disposed plate 46 and rod 41 in an abutting relation to a dominant knee joint of the golfer on the posterior side thereof. A front barrier wall 90 is in a spaced relation with the spherical ball 80 in an abutting relation to the dominant knee joint of the golfer on the anterior side. A side barrier wall 88 is positioned proximate the front barrier wall 90 in an abutting relation to the dominant knee joint on the dominant side, wherein the golfer positions the dominant knee joint between the spherical ball 80 and the front barrier wall 90 and positions the dominant side of the dominant knee in abutting relation to the side barrier wall 88 and bends the knee joint by a predetermined amount prior to performing the golf swing. The side barrier wall 88 prevents a dominant leg of the golfer from moving longitudinally towards the dominant side of the golfer's body during the back swing. The spherical ball 80 and the front barrier wall 90 combination causes the golfer to lose balance if an attempt is made to straighten the dominant knee during the golf swing. The dominant knee is constrained to move longitudinally and generally parallel to a target line. With continued reference to FIG. 17, a vertically disposed barrier wall 148 is anatomically spaced from and longitudinally opposed the side barrier wall 88 on a non-dominant side of the golfer and in an abutting relation to a non-dominant leg of the golfer. The vertically disposed barrier wall 148 is adjustable for positioning proximate and below a non-dominant hip when the golfer is in a ball-addressing position. The vertically disposed barrier wall 148 provides feedback to the golfer when the body of the golfer moves toward a target during the forward motion of the swing, thus training the golfer to make a swinging motion more rotary than linear. With such an apparatus, the golfer learns to shift weight to the non-dominant leg at the conclusion of the swing.

In another apparatus combination, a golf swing training apparatus useful in developing a desired backswing including a placing of a golf club in a preferred position at the top of the swing may include the apparatus combination illustrated with reference to FIG. 18, by way of example. With continued reference to FIG. 18 and to FIGS. 5A, 5B, 12A, 12B, 13A, and 13B, a first elongate, telescoping pole 120 may be pivotally mounted for movement in a vertical plane so that the pole 120 may be tilted from within the vertical plane such that a distal end is positioned over the dominant shoulder of the golfer when the golfer is in a ball-addressing position. The pole 120 provides a barrier that is struck by the arms of the golfer when lifted to a height above a desired height during a back swing. A horizontally disposed elbow barrier 256 is anatomically spaced from the first elongate pole 120 and positioned on a dominant side of the golfer proximate shoulder height and at a longitudinal spacing equal to about the length of the golfer's upper arm. The elbow barrier 256 provides feedback to the golfer when a dominant elbow of the golfer strikes the elbow barrier 256. The elbow barrier 256 is struck by the dominant elbow only when the golfer performs a back swing and the dominant elbow is lifted more than ninety degrees (90°) relative to the position of the elbow at address. A planar barrier 282 is disposed generally above the pole 120 and the barrier 256 in an angled plane at a predetermined angle relative to a vertical plane. The planar barrier 282 is oriented so that a top edge is adapted to be closer to the golfer's head than a bottom edge. The planar barrier 282 provides feedback to the golfer at the top of a golf swing if the arms of the golfer and a club shaft are not in a desired position at the top of the golf swing. The golf club shaft strikes the planar barrier 282 at the top of the golf swing when the golf swing moves outside a desired swing plane partially defined by the barrier.

As illustrated with reference again to FIG. 18 and FIGS. 5A and 5B, a second elongate, telescoping pole 124 may be pivotally mounted for movement in a vertical plane, wherein a distal end of the second pole 124 is positioned over the non-dominant shoulder of the golfer in a parallel relation to the first pole 120 when the golfer is in a ball-addressing position. The second pole 124 provides a barrier that is struck by the arms of the golfer when the arms are lifted to a height above a desired height during the follow-through portion of the swing.

By way of further example, and with reference to FIG. 19 and again to FIGS. 10A, 10B, 8A, 8B, 9A, 9B, a golf swing training apparatus useful in developing a desired golf club take-away motion during an initial back swing movement may include the hemispherical barrier 214 disposed at a predetermined angle relative to a target line. The hemispherical barrier 214 is be disposed on a non-dominant side of the golfer at a longitudinal distance equal to about one club length. The hemispherical barrier 214 provides feedback when struck during the take-away movement in the backswing when the take-away movement is not performed in a desired manner. The hemispherical barrier 214 provides further feedback when struck during a backswing and downswing movement when the downswing is not performed in the desired manner. A barrier wall 188 is spaced from and behind the hemispherical barrier 214 and generally parallel the target line, as illustrated with continued reference to FIG. 19. The barrier wall 188 is disposed at ninety degrees (90°) relative to the target line and positioned on a non-dominant side of the golfer in longitudinally spaced relation. The barrier wall 188 is struck by a golf club if hinged by the golfer in an undesirable manner by the breaking of the wrists. A horizontally disposed rod 208 longitudinally extends from the barrier wall 188 toward the golfer in a plane parallel to the target line. The horizontally disposed rod 208 has a free distal end for providing a barrier that is struck by the golfer's hands during a take-away movement of the backswing when the golfer's hands move away from the golfer's body by a predetermined distance and during a downswing movement if the golfer's hands move away from the golfer's body by the predetermined distance.

The hemispherical barrier 212 may be pivotally mounted for rotation about a vertical axis to enable adjustment of the angular position relative to a target line. Further, a vertically disposed, longitudinally extending flap 190 may be mounted on the barrier wall 188 and positioned in a plane rearward a plane through which the golf club travels during the desired take-away movement. The vertically disposed flap 190 is struck by the golf club when the golfer does not perform the desired take-away movement. Yet further, the barrier wall 188 may include a transparent portion for viewing the golf swing through the barrier wall.

Figure 17:
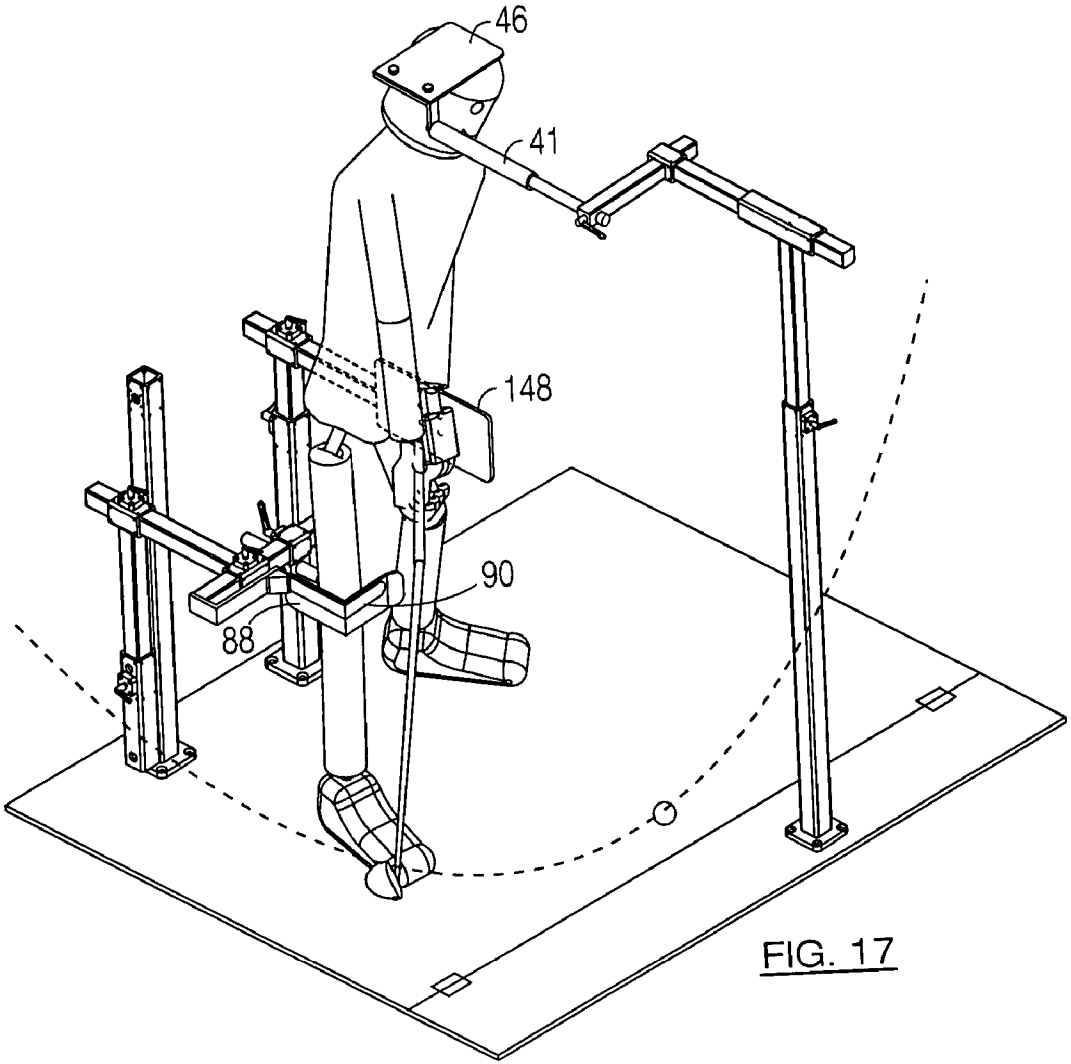
FIGS. 17–19 are perspective views illustrating various apparatus sub-combinations of the apparatus illustrated in FIGS. 1A and 1B.
Figure 18:
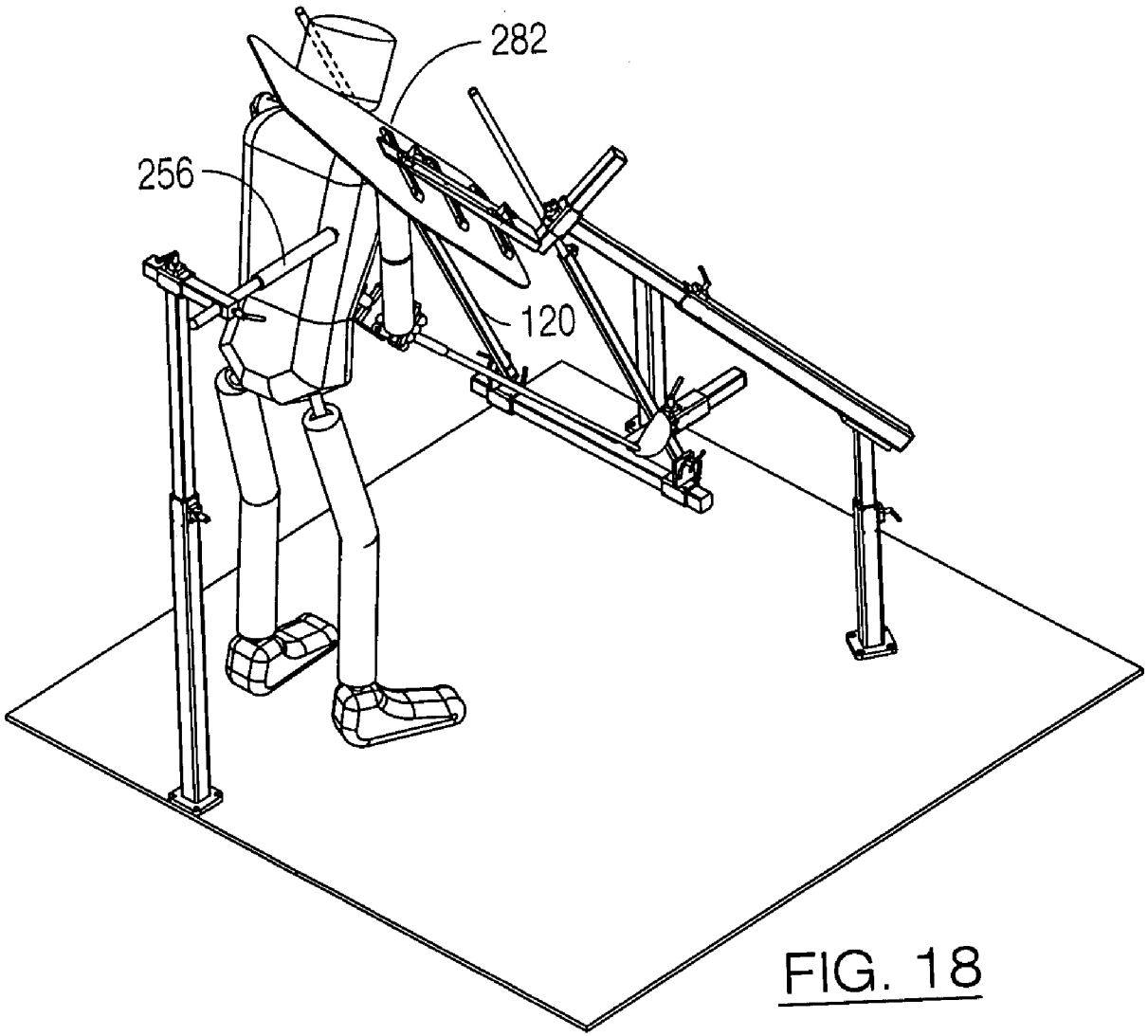
Figure 19:
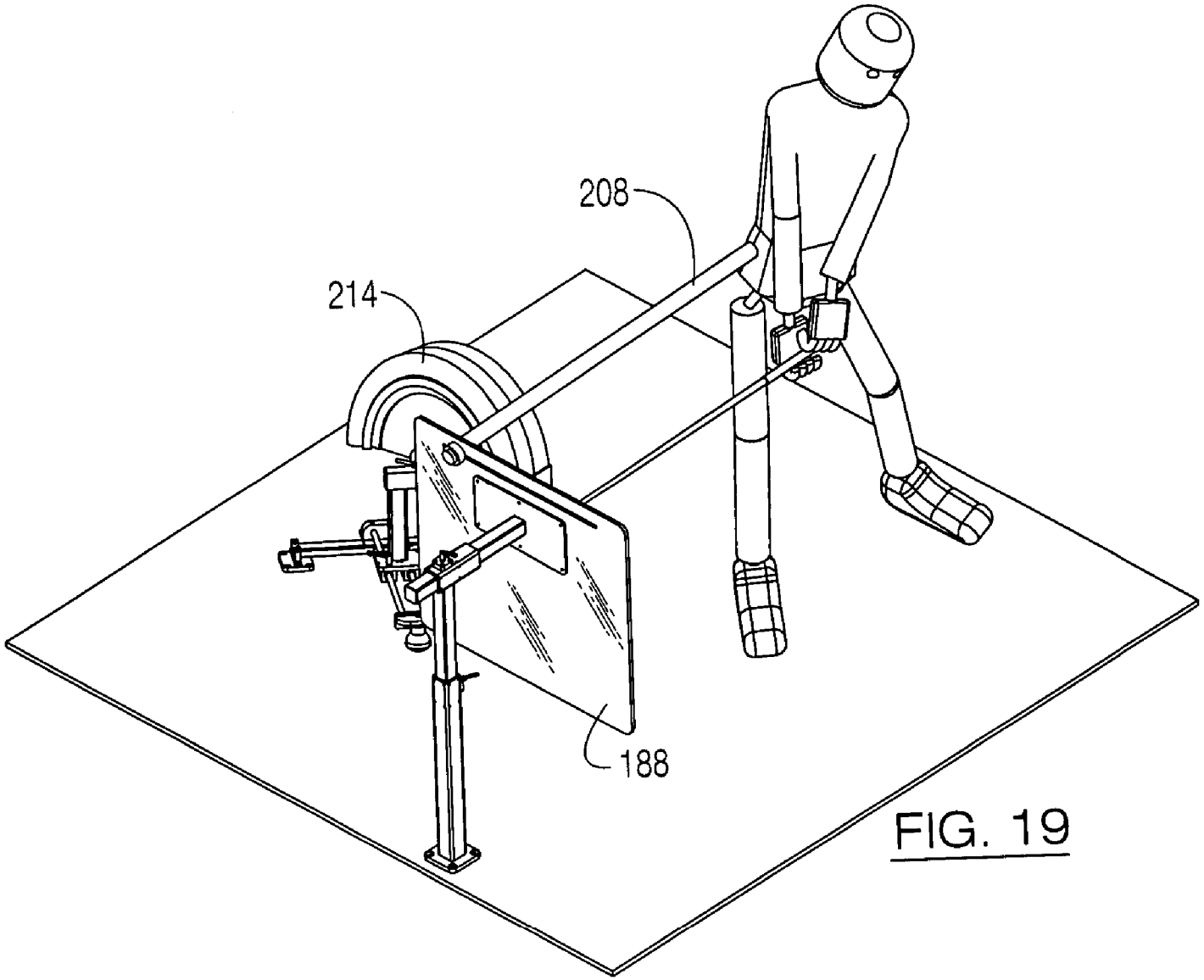

As illustrated by way of example with reference to FIGS. 17–19, various combinations of apparatus herein described may be used to perfect or train particular aspects of the golf swing. By way of further example, a golf swing training apparatus combination useful in developing a desired golf club take-away motion during an initial back swing movement may include a vertical rod 152 positioned just inside a stance line of a golfer, as illustrated with reference to FIGS. 7A and 7B. The vertical rod 152 is spaced from the dominant side of the golfer for providing a barrier that is struck by a golf club head during a take-away movement of the backswing when the golf club head travels more than a predetermined distance inside a plane that is parallel to the stance line, the vertical partially defining the plane. The barrier wall 188, earlier described with reference to FIGS. 8A and 8B, is spaced from and longitudinally back of the vertical rod 152 parallel the target line. The barrier wall 188 is at ninety degrees (90°) relative to the target line and positioned on a non-dominant side of the golfer in longitudinally spaced relation. The barrier wall 188 is struck by a golf club if hinged in an undesirable manner by the golfer. The horizontally disposed rod 208 extends from the barrier wall 188 toward the golfer in a plane parallel to the target line, as described earlier with reference to FIG. 19 and related drawings. The horizontally disposed rod 208 has a free distal end for providing a barrier that is struck by the golfer's hands during a take-away movement of the backswing when the golfer's hands move away from the golfer's body by a predetermined distance and during a downswing movement if the golfer's hands move away from the golfer's body by the predetermined distance.

Further, a vertically disposed, longitudinally extending flap 190 may be mounted on the barrier wall 188, as illustrated earlier with reference to FIGS. 8A and 8B. The vertically disposed flap 190 is positioned in a plane rearward a plane through witch the golf club travels during the desired take-away movement, and is struck by the golf club when the golfer does not perform the desired take-away movement. The club head barrier 306 may be positioned at a location where a golf ball to be put into play would be positioned so that the golfer may adopt a ball-addressing stance and position a club head into abutting contact with the club head barrier 306, wherein muscle memory is acquired for a desired stance. Yet further, and with reference again to FIG. 14B, the club shaft barrier 326 may be positioned at a location where a club shaft would be positioned so that a golfer may adopt a ball-addressing stance and position a club shaft into abutting contact with the club shaft barrier, wherein muscle memory is acquired for a desired stance.

A golf swing training apparatus useful in training a downswing portion of a golf swing may include the vertically disposed rod 152 positioned inside the stance line of the golfer in a spaced relation from a dominant side of the golfer, as illustrated with reference again to FIG. 7B, serving as a barrier that is struck by the club head during the take-away movement of the golf swing when the club head travels more than a predetermined optimal amount inside a plane that is parallel to the stance line. The planar barrier 218, as earlier described and illustrated with reference to FIG. 11B, is positioned at a predetermined angle relative to a target line for placing the planar barrier 218 in spaced relation to the dominant shoulder of the golfer, wherein the planar barrier 218 provides feedback when struck during a golf swing. The golfer's hands strike the barrier 218 during the backswing and downswing when the swing is not performed in a desired manner. The pole 120 mounted in upstanding relation to a follow-through barrier rod 340 is carried by the pole 120 and extends transversely in a horizontal plane at ninety degrees (90°) relative to the target line. The follow-through barrier rod 340 may be positioned on a non-dominant side of the golfer for providing feedback to the golfer when the golfer's hands strike the follow-through barrier rod 340 during a follow-through portion of the golf swing. The planar barrier 218 is readily movable for mitigating injury to the golfer when struck.

In an example using a combination of the apparatus for training a downswing portion of a golf swing, the hemispherical barrier 212, described earlier with reference to FIGS. 10*a* and 10B, is at a predetermined angle relative to a target line. The hemispherical barrier 212, 214 is disposed on a non-dominant side of the golfer at a longitudinal distance equal to about one club length, wherein the hemispherical barrier provides feedback when struck during the take-away movement in the backswing when the take-away movement is not performed in a desired manner. The hemispherical barrier 214 further provides feedback when struck during a downswing movement when not performed in the desired manner. The planar barrier 218 may further be positioned at a predetermined angle relative to a target line for placing the planar barrier 218, described earlier with reference to FIGS. 11A and 1B, may be spaced from the dominant shoulder of the golfer for providing feedback when struck during a golf swing, or struck by the hands of the golfer during the backswing and downswing when not performed in a desired manner. The pole 120 may be mounted in the upstanding relation to the follow-through barrier rod 340 carried by the pole and extending transversely from it in a horizontal plane at ninety degrees (90°) relative to a target line, as illustrated with reference again to FIGS. 15A and 15B. The follow-through barrier rod 340 is positioned on a non-dominant side of the golfer for providing feedback to the golfer when the hands of the golfer strike the follow-through barrier rod during a follow-through portion of the golf swing. The hemispherical barrier 212 may be pivotally mounted for rotation about a vertical axis to enable adjustment of the angular position thereof relative to a target line. The planar planar barrier 218 is readily movable for mitigating injury to the golfer when struck.

A common thread running through all of the above embodiments is the absence of restraints or harnesses worn by the golfer, the absence of restraints or harnesses that attach to the golf club, and the presence of barrier means that provide negative feedback when struck. When using the above-described apparatus, the golfer acquires muscle memory that becomes a permanent part of the golfer's game, unlike restraints and harnesses that must be removed during play.

Since certain changes may be made in the above construction without departing from the scope of the invention, it is intended that all matters contained in the foregoing description or shown in the accompanying drawings shall be interpreted as illustrative and not in a limiting sense. It is also to be understood that the following claims are intended to cover generic and specific features of the invention herein described, and all statements of the scope of the invention that, as a matter of language, might be said to fall therebetween.

The invention claimed is:

1. An apparatus for teaching a golfer how to set up for a putt, comprising:

a base having a longitudinally-extending main part disposed in parallel with a target line;

a pair of brackets secured to the base, there being one bracket at each end of the base;

an elongate guide plate having opposite ends secured by the brackets;

the brackets adapted to enable height-adjustability of the elongate guide plate;

the brackets adapted to enable pivoting of the elongate guide plate about a longitudinal axis;

knee position-locking means for holding a golfer's knees in a predetermined optimal position;

the knee position-locking means being independently adjustable along a longitudinal extent of the knee position-locking means;

the knee position-locking means adapted to enable height-adjustability of the knee position-locking means;

shoulder and forearms-guiding means for positioning a golfer's shoulders and forearms in an optimal position;

the shoulder and forearms-guiding means being longitudinally disposed in parallel with the target line;

the elongate guide plate positioned at a predetermined angle that matches an angle of a golf club shaft when addressing a golf ball to be putted;

whereby a golfer learns an optimal putting stance for performing a golf putt of the arc stroke type by placing his or her knees in abutting relation to the knee position-locking means, placing his or her shoulders and forearms parallel relation to the shoulder and forearms-guiding means, positioning a golf club shaft in overlying, abutting relation to the elongate guide plate, and performing a golf putting stroke of the arc stroke type by maintaining the golf club shaft in abutting relation to the elongate guide plate during the putting stroke.

* * * * *

UNITED STATES PATENT AND TRADEMARK OFFICE

CERTIFICATE OF CORRECTION

PATENT NO. : 7,150,683 B2
APPLICATION NO. : 11/264656
DATED : December 19, 2006
INVENTOR(S) : Michael E. Bender It is certified that error appears in the above-identified patent and that said Letters Patent is hereby corrected as shown below:

On title page item (22) Filed: Please delete "Feb. 13, 2006" and insert --Nov. 1, 2005--

Signed and Sealed this

Sixth Day of November, 2007

JON W. DUDAS
*Director of the United States Patent and Trademark Office*